United States Patent [19]

Hall

[11] 4,311,077

[45] Jan. 19, 1982

[54] ELECTRONIC MUSICAL INSTRUMENT CHORD CORRECTION TECHNIQUES

[75] Inventor: Robert J. Hall, Chatsworth, Calif.

[73] Assignee: Norlin Industries, Inc., White Plains, N.Y.

[21] Appl. No.: 156,473

[22] Filed: Jun. 4, 1980

[51] Int. Cl.[3] ..... G10H 1/42; G10H 7/00

[52] U.S. Cl. ..... 84/1.03; 84/DIG. 12

[58] Field of Search ..... 84/1.01, 1.03, 1.17, 84/1.24, DIG. 12, DIG. 22

[56] References Cited

U.S. PATENT DOCUMENTS 3,745,225 7/1973 Hall ..... 84/1.03

*Primary Examiner*—Stanley J. Witkowski

*Attorney, Agent, or Firm*—Allegretti, Newitt, Witcoff & McAndrews

[57] ABSTRACT

An electronic musical instrument by which a performer can provide a musical accompaniment in different musical harmonies by playing on a standard keyboard. The performer adjusts a tempo clock in order to determine the period of the rhythmic beat of the accompaniment. The instrument enables the performer to change to a different harmony at the end of a beat (e.g., by changing his hand position on the keyboard) without interrupting the continuity of the accompaniment and to hear much of the subsequent beat in the changed harmony even if his hand does not complete the change to the new harmony position until a portion of the subsequent beat has elapsed.

14 Claims, 21 Drawing Figures

ELECTRONIC ORGAN CIRCUITRY
OSCILLATOR
HARMONIC SPECTRUM ADJUSTER
MODULATOR
ENVELOPE GENERATOR
KEMPO
BOSSA NOVA
BIG BAND
BARO QUE
JAZZ GUITAR
CONTEMPORARY GUITAR & CELLI
GENERAL PURPOSE RAM
PROGRAM ROM
ORCHESTRATION & INSTRUMENT ROM
MICRO-PROCESSOR
LATCH
COUPLING NETWORK

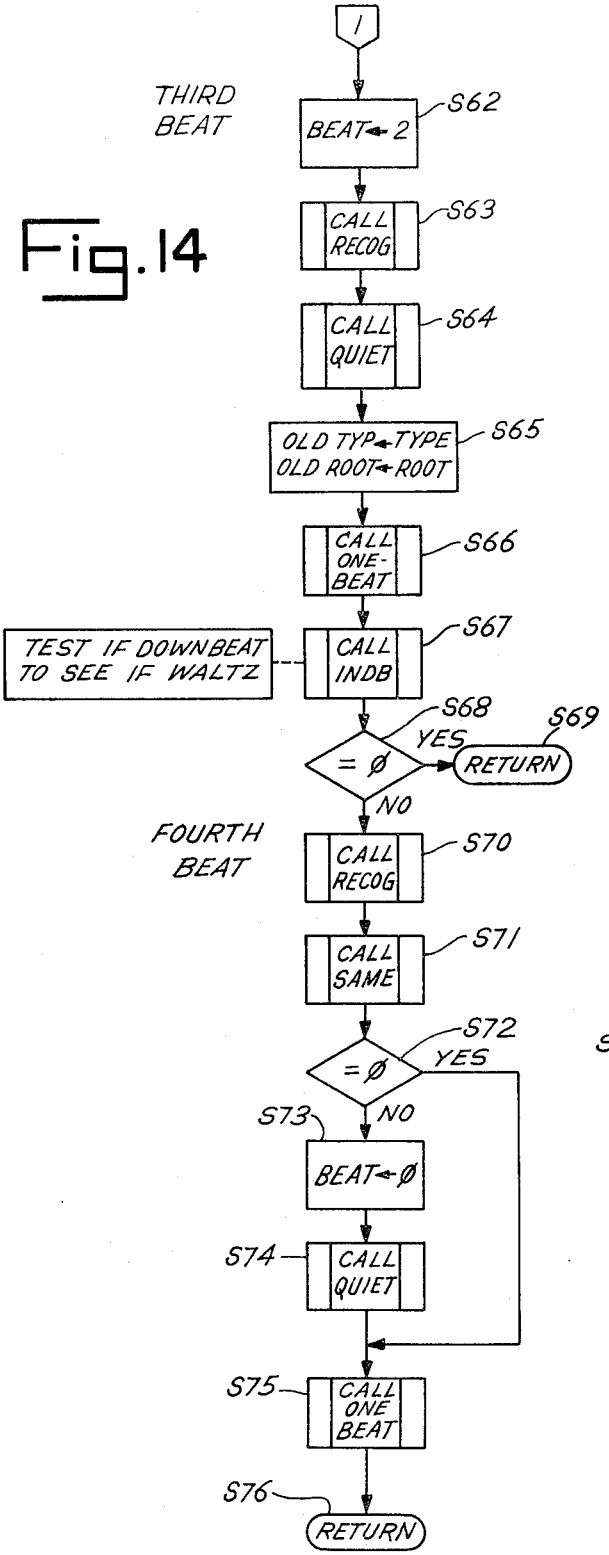
Fig. 14
Fig. 15
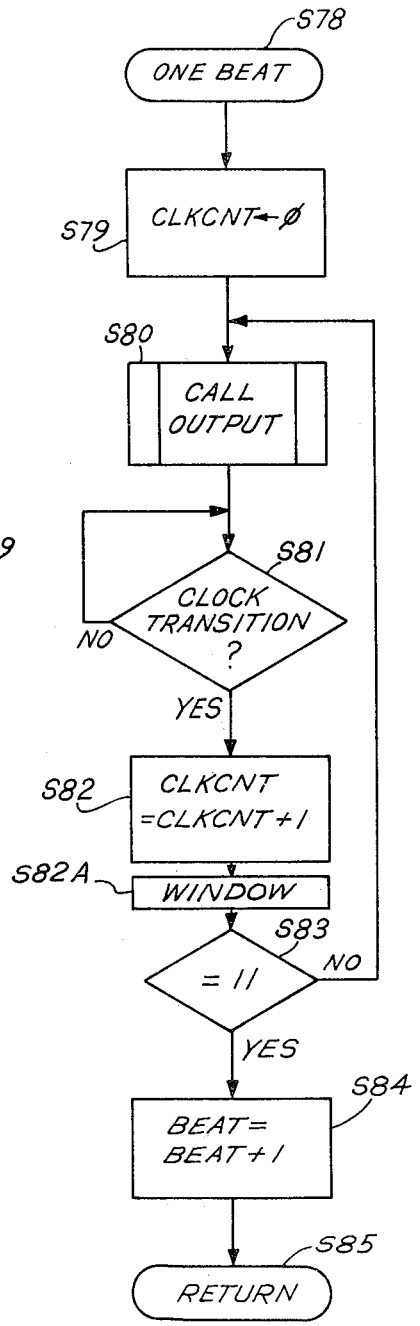

WINDOW
S120
IS CLKCNT ≤ 6
YES
NO
S121
CALL RECOG
CALL SAME
S122
DOES OLD TYPE=TYPE AND OLD ROOT=ROOT
S123
YES
NO
S124
IS BEAT=2 OR 4
NO
YES
BEAT = Ø
S125
CLKTEMP=CLKCNT
CLKCNT = Ø
OLD TYP = NEW TYPE
OLD ROOT = NEW ROOT
S126
CALL POOT
S127
DOES CLKCNT=CLKTEMP
S128
YES
NO
S129
CLKCNT = CLKCNT + 1

POOT

ELECTRONIC MUSICAL INSTRUMENT CHORD CORRECTION TECHNIQUES

BACKGROUND AND SUMMARY OF THE INVENTION

This invention relates to electronic musical instruments, and more particularly relates to such instruments capable of providing an accompaniment in different harmonies selected by a performer.

Electronic musical instruments, such as keyboard-controlled electronic organs, have experienced wide acceptance among musicians. Since many of these instruments are sold to amateurs, manufacturers have placed special emphasis on featurs which promote ease of playing. In particular, the electronic musical instrument industry has long sought a method of producing an accompaniment in different harmonies which can be selected easily by a performer of limited skill or musical knowledge.

Attempts in this direction have been made in the past. For example, U.S. Application Ser. No. 3,584, entitled "Orchestral Accompaniment Techniques", filed Jan. 15, 1979 in the names of R. J. Hall, G. R. Hall and J. C. Cookerly and assigned to the same assignee as this application, describes a major advance in generating and controlling a musical accompaniment by an electronic musical instrument. This application is incorporated by reference.

The instrument includes a tempo clock which divides each musical measure into beats and each beat into 12 subparts. The instrument plays an accompaniment depending on the harmony selected by the performer by depressing keys on a standard keyboard. In order to minimize the skill required by the performer, the instrument recognizes only the harmony selected at the beginning of a musical beat. As a result, the performer can lift his hand from the keyboard and begin selecting another harmony as soon as the beat has commenced. The accompaniment continues for the duration of the beat in the selected harmony even though the performer's hand is no longer depressing any keys.

Experience has shown that the foregoing arrangement creates difficulties for the performer who is so unskilled that his selection of harmony is not completed until after a beat has commenced. If no harmony (or an improper harmony) is selected at the beginning of a beat, the lack of harmony (or improper harmony) will continue through the entire beat even though the performer selects the proper harmony a fraction of a second after the beat commences.

Thus, it is one object of the invention to provide an electronic musical instrument which facilitates the selection of harmony, preferably on a keyboard.

Another object is the correction of the harmony of a musical accompaniment in response to a performer who selects the harmony "behind the beat".

The applicant has discovered a unique apparatus and method for achieving these objectives. In principal apparatus aspect, the invention is used in an electronic musical instrument which controls the production of a musical accompaniment defined in part by rhythmic beats having a predetermined period. The instrument also includes harmony selection means. Means are provided for dividing the beats into first and second time segments. Additional means generate a segment of music depending on the harmony selected by the performer. During the first time segment, the means modify the accompaniment in response to a change in the selected harmony. During the second time segment, the means inhibit a change in the accompaniment due to a change in the selected harmony.

According to the principal method aspect of the invention, music signals are stored and addressed at differential rates when a harmony change occurs during the first time segment. Changes in accompaniment are inhibited when a harmony change occurs during the second time segment.

By using the foregoing techniques, the performer can change to a different harmony at the end of a beat without interrupting the continuity of the accompaniment and can hear much of the subsequent beat in the changed harmony even if the change is not completed until a portion of the subsequent beat has elapsed. Thus, harmony can be changed by an unskilled performer with a degree of accuracy and ease previously unattainable.

DESCRIPTION OF THE DRAWINGS

These and other objects, advantages and features of the present invention will appear for purposes of illustration, but not of limitation, in connection with the accompanying drawings, wherein like numbers refer to like parts throughout, and wherein:

FIGS. 11–19 are flow charts illustrating the overall operation of the preferred embodiment;

DESCRIPTION OF THE PREFERRED EMBODIMENT

I. General Capabilities

An electronic musical instrument made in accordance with the preferred embodiment of the invention is capable of providing a full orchestral accompaniment to a melody played in any one of the 12 possible harmonic keys. The accompaniment easily can be controlled by the left hand of a performer who is playing the melody with his right hand on a melody keyboard. The accompaniment is "played" by the instrument in any one of a variety of different musical "styles", such as bossa nova, big band, baroque, jazz guitar, or contemporary guitar and celli. The musical style desired by the performer is selected by a switch located on the instrument console. The performer also adjusts a tempo clock so that the accompaniment is "played" by the instrument in time with the melody being played by the performer.

The instrument automatically relates the accompaniment to the harmony selected by the left hand of the performer on a harmony keyboard. Thus, the accompaniment is "played" both in the style and harmony selected by the performer as most appropriate for the melody he is playing.

The instrument normally generates a segment of orchestrated accompaniment music which is repeated after every two musical bars. That is, a normal segment of accompaniment music consists of two musical measures or bars, and each bar contains four musical beats. A waltz segment consists of two bars, and each bar contains three beats.

The instrument analyzes the manipulation of the harmony keyboard in order to ascertain the accompaniment harmony desired by the performer. In particular, the instrument identifies a specified chord type and root note. The chord types recognized by the instrument are major, minor, diminished, augmented and seventh, and the root note can be any of the twelve notes of the musical chromatic scale.

In order to add variety to the musical accompaniment segments, the twelve possible roots are divided into four groups as follows:

| Group Number | Root Note |
|---|---|
| 0 | C, C#, E |
| 1 | D#, F#, and D |
| 2 | F, G#, and A |
| 3 | G, A#, and B |

(Throughout this specification, a musical sharp is indicated by the symbol #.)

As described in detailed in connection with FIGS. 15–18, the segment of accompaniment music produced by the instrument tends to change each time the performer plays a new chord type or a chord in a new root group. Since there are five possible chord types and four possible root groups, twenty different and unique musical segments can be produced for each musical style. In other words, for any given style of music, there are twenty different music segments arranged to express the style.

Figure 1:
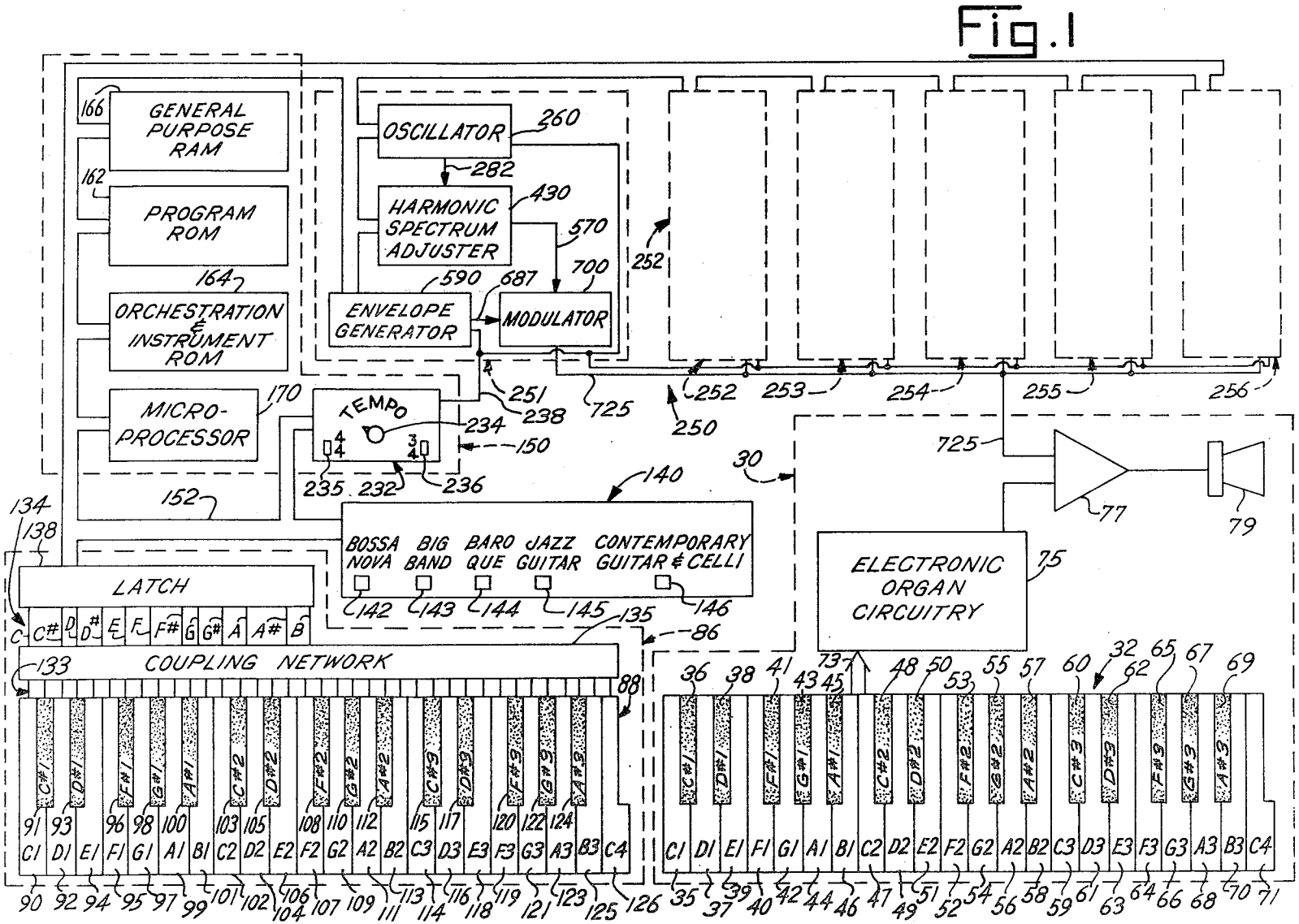
FIG. 1 is a logical block diagram of a preferred form of musical instrument made in accordance with the present invention.

II. Description of Harmony Selection, Style Selection And Processing Apparatus Referring to FIG. 1, a preferred form of electronic musical instrument having the foregoing capabilities basically comprises a melody system 30, a harmony selection system 86, a musical style selector 140, a processing system 150 and an output system 250. As shown in FIG. 1, melody system 30 includes a conventional melody keyboard 32 which comprises playing keys 35–71. Each of the keys represents at least one note which is pitched in at least one octave. Keyboard 32 is connected through a cable 73 to conventional electronic organ circuitry 75. The circuitry produces audio tone signals based on the melody keys depressed by the performer in a well-known manner. The tone signals are transmitted through an output amplifier 77 to a conventional loudspeaker transducer 79 which converts the signals to sound.

Harmony selection system 86 comprises a harmony keyboard 88, including playing keys 90–126. The keys operate switch contacts 133 which correspond to switches 23 described in U.S. Pat. No. 3,745,225 (Hall-July 10, 1973, hereafter the "3,745,225 Patent"). The switch contacts are connected to output conductors 134 (corresponding to conductors 24 of the 3,745,225 Patent) by a coupling network 135 of the same type described in that patent. Conductors 134 are connected to a conventional 12 bit latch 138 which can be addressed and read by processing system 150.

Each of the keys of keyboard 88 represents at least one note pitched in at least one octave. One such note and octave is printed on the keys in FIG. 1. For example, key 90 is used to produce at least a C note pitched in octave 1, and key 106 is used to produce at least an E note pitched in octave 2. As explained in the 3,745,225 Patent, coupling network 135 is arranged so that the playing of any key on keyboard 88 which corresponds to a C note results in a logical one signal on the C conductor of group 134, irrespective of the octave in which the C note is pitched. For example, the C conductor in group 134 will be raised to a logical one state if any or all of keys 90, 102, 114 or 126 are depressed by a performer. As a result, the input to latch 138 represents each of the notes produced by a performer's manipulation of keyboard 88, but does not indicate in which octave any of the notes are pitched.

Musical style selector 140 comprises switches 142–146 by which a performer can select several musical styles. In response to the depression of one of switches 142–146, an eight bit word corresponding to the desired style is stored in a conventional eight bit register contained within selector 140. The word is read by processing system 150 and is used in a manner described later. Of course, the instrument could be expanded to include other musical styles, depending on the size of the processing system desired. Those skilled in the art readily will be able to expand the scope of the instrument to include other musical styles based on the present teaching.

Figure 2:
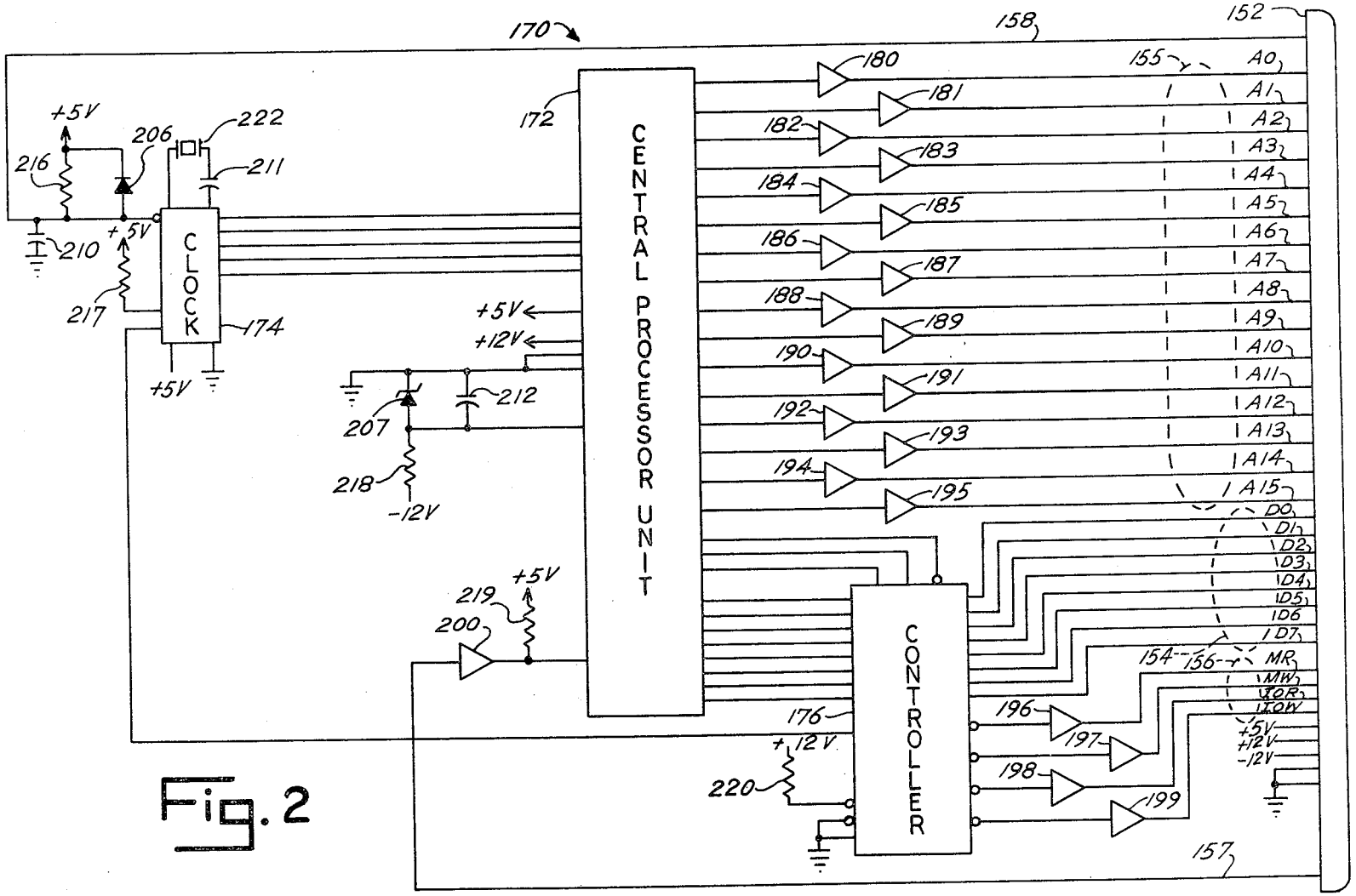
FIG. 2 is an electrical schematic diagram of a preferred form of a microprocessor made in accordance with the present invention.

Referring to FIGS. 1 and 2, processing system 150 comprises a communication bus 152 that is subdivided into an eight bit data bus 154, a sixteen bit address bus 155, a four bit read-write bus 156, an interrupt line 157 and a clock line 158.

The processing system also includes a program read only memory (ROM) 162 which stores instructions for the overall system. An orchestration and instrument ROM 164 stores digital information necessary for the production of the musical segments. A general purpose random access memory (RAM) 166 is used to hold intermediate variables and working data pointers used by a microprocessor 170 which performs sequential programmed logic functions in order to operate the system.

Referring to FIG. 2, microprocessor 170 comprises a central processor unit 172 which may be a general purpose microcomputer, such as model 8080 manufactured by Intel Corporation. The microprocessor also includes a processor clock 174 which may be a model 8224 manufactured by Intel Corporation, and a system controller 176 which may be a model 8228 manufactured by Intel Corporation. The microprocessor also includes amplifiers 180–200, diodes 206–207, capacitors 210–212, resistors 216–220, and a crystal 222, all connected as shown.

Figure 3:
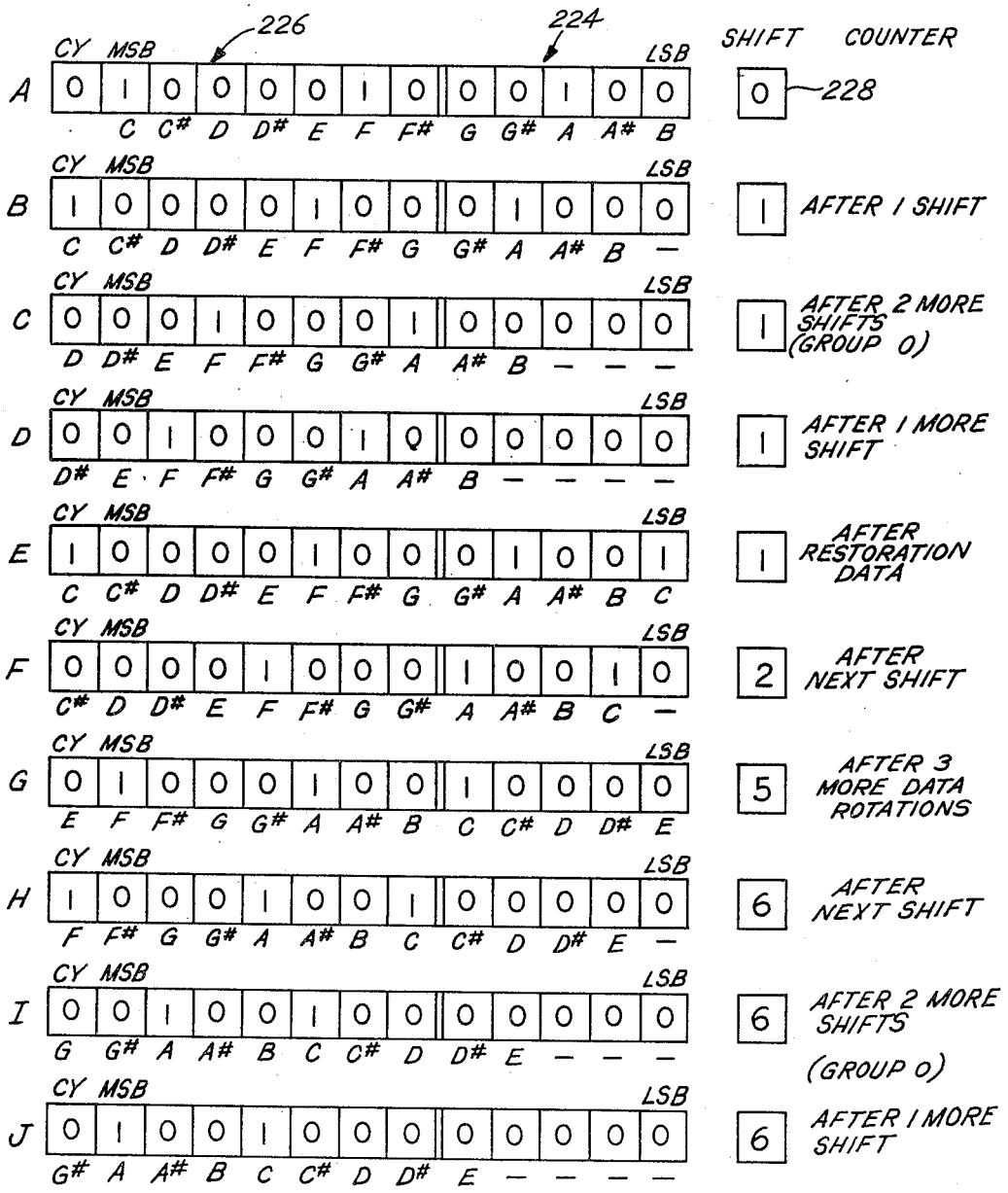
FIG. 3 is a block diagram illustrating the operation of certain registers in the microprocessor.

Referring to FIG. 3, microprocessor 170 also includes a four bit register 224 and an eight bit register 226 that comprises a carry bit CY, a most significant bit MSB and a least significant bit LSB. The purpose of a shift counter bit 228 is described later.

Referring to FIG. 1, a tempo clock 232 is provided in order to synchronize the system with the performer. The tempo clock may be speeded up or slowed down to suit the tempo at which the performer wishes to play. The tempo is established by rotating knob 234 which adjusts the rate at which tempo clock pulses are generated.

The tempo clock issues twelve tempo clock pulses per musical beat so that it can resolve a quarter note beat into eighth notes, sixteenth notes or triplets. A normal musical bar consists of four beats; each bar is broken into two parts, each of which has two beats. A waltz-type bar consists of three beats; each bar is broken into two parts, the first part being two beats and the second part being one beat.

The tempo clock is used by the system to establish a pattern for the repetition of the two bar musical segments. A segment is repeated after every two bars. That is, a normal segment consists of two normal bars, each made up of four beats so that an eight beat pattern results. A waltz segment consists of two waltz bars having three beats per bar, so that a six beat pattern results. A (4/4) time switch 235 and a ($\frac{3}{4}$) time switch 236 enable a performer to adjust the output of the tempo clock to the appropriate time pattern. Tempo clock 232 generates a downbeat pulse at the beginning of each musical bar which synchronizes the system in a manner described later. The downbeat pulse and tempo clock pulses are transmitted to other parts of the system over data bus 154 and conductor 238.

III. Harmony Recognition

Harmony selection system 86 cooperates with processing system 150 in order to recognize the harmony indicated by the depression of one or more keys of keyboard 88 by the performer. Of course, the preferred embodiment could be implemented with a chord organ-type pushbutton system in which a separate button is provided for each chord type and root note desired by the performer. However, such a pushbutton system is not satisfying to the more advanced musician who is used to playing on a keyboard in order to establish the harmony of his musical performance.

By using the following technique, the harmony desired by the performer can be recognized solely from his manipulation of keyboard 88. In order to recognize any chord type, the microprocessor attempts to match a representation of a playing key pattern with a corresponding chord type and root. In order to achieve this result, signal-responsive representations of various playing key patterns are stored in memory. A performer may express a desire for a particular chord type based on a particular root by depressing the playing keys according to a number of different patterns. For example, the performer may express a desire for C minor harmony (i.e., chord type minor, root C) by actuating any one of the following key patterns:

1. C, D♯
2. C, D♯, G
3. C, D♯, G, B
4. C, D♯, B
5. D♯, F, A♯
6. C, D♯, F, A♯
7. C, D♯, F, G

These key patterns can be used by the processor in order to derive a chord type signal indicating the chord type desired by the performer and a root signal indicating the root note of the harmony desired by the performer.

More specifically, for each chord type desired to be recognized, a plurality of chord pattern signals representing corresponding key patterns are stored in memory locations having addresses related to that chord type. After the chord pattern signals have been stored, harmony selection system 86 generates a playing key pattern signal identifying the pattern of the playing keys actuated by the performer and also identifying at least one note represented by at least one of the actuated playing keys. The playing key pattern signal then is used in an attempt to locate a corresponding stored chord pattern signal. The chord type signal and root signal are derived from the corresponding chord pattern signal.

As previously explained, harmony selection system 86 produces on conductors 134, a multi-bit representation of the keys of keyboard 88 actuated by a performer. The note represented by an actuated key is represented on one of conductors 134 irrespective of the octave in which it occurs. For example, the C conductor of bus 134 is raised to a logical one state if any one of keys 90, 102, 114 or 126 representing C notes sounded in octaves 1, 2, 3 or 4 respectively, are actuated. Referring to FIG. 1 and 3, the twelve bit representation of the playing key pattern is stored in latch 138 and is transferred by processor 170 into four bit register 224 and eight bit register 226 over bus 152.

Figure 5:
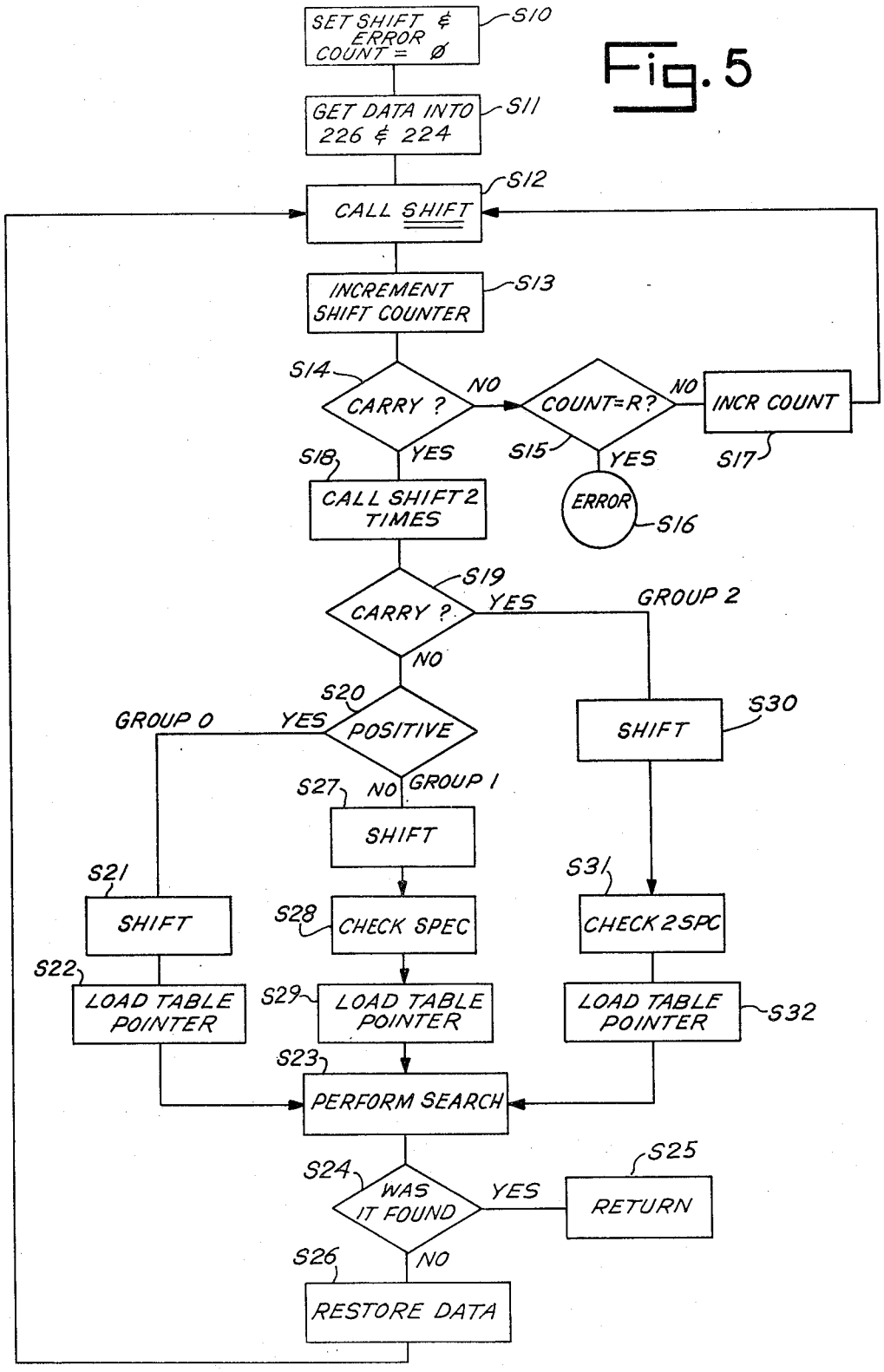
FIG. 5 is a flow chart illustrating the manner in which the processor determines the harmony desired by a performer.

FIG. 5 describes the harmony recognition routine of the program instructions stored in ROM 162. Briefly, the twelve bit playing key pattern signal stored in registers 224,226 can be reduced to an eight bit representation by judiciously testing certain bits and properly grouping others. Details of the harmony recognition routine are given in the above-identified application Ser. no. 3,584 which is incorporated by reference.

Figure 4:
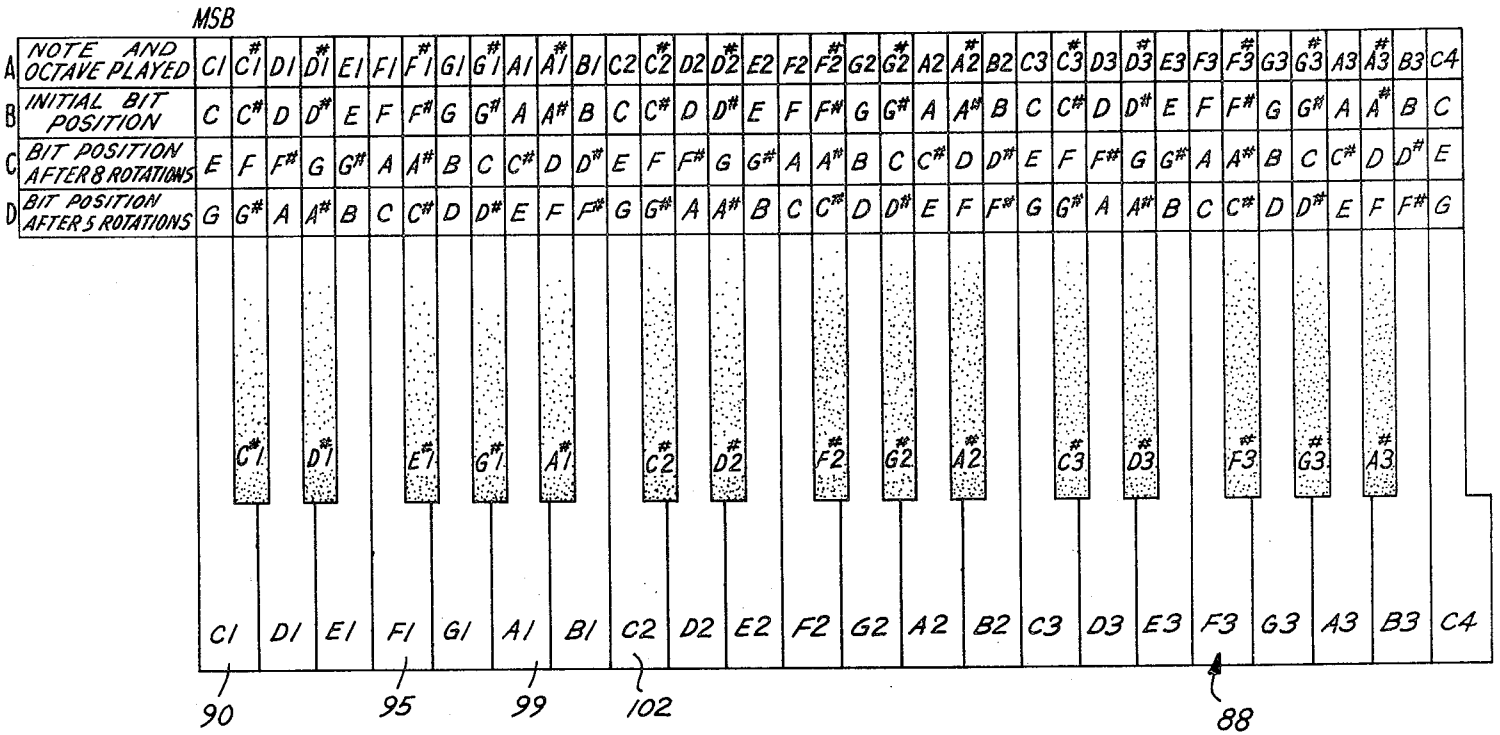
FIG. 4 is a chart illustrating the general operation of the registers shown in FIG. 17.

FIG. 4 illustrates how the data representing any combination of played keys is shifted through registers 224,226. Line A represents the notes and octaves resulting from the playing of the keys aligned with the entries in line A. Line B illustrates the notes initially represented by the bit positions in registers 224,226. Lines C and D illustrate the notes represented by the bit positions of registers 224,226 after 8 and 5 data rotations respectively. With the aid of FIG. 4, those skilled in the art can readily trace the rotation of data representing any combination of played keys.

IV. Output Hardware

Referring to FIG. 1, output system 250 comprises identical voice systems 251–256. Each of the voice systems is capable of simulating a separate instrument or voice by which segments of musical accompaniment can be expressed. At any one time, any voice system can sound like any instrument the system is capable of simulating. In other words, the individual voice systems are not confined to a single voice or instrument simulation.

Each of the voice systems can be understood from the following description of system 251. System 251 basically comprises an oscillator circuit 260, a harmonic spectrum adjuster 430, an envelope generator 590 and a modulator 700.

Figure 6:
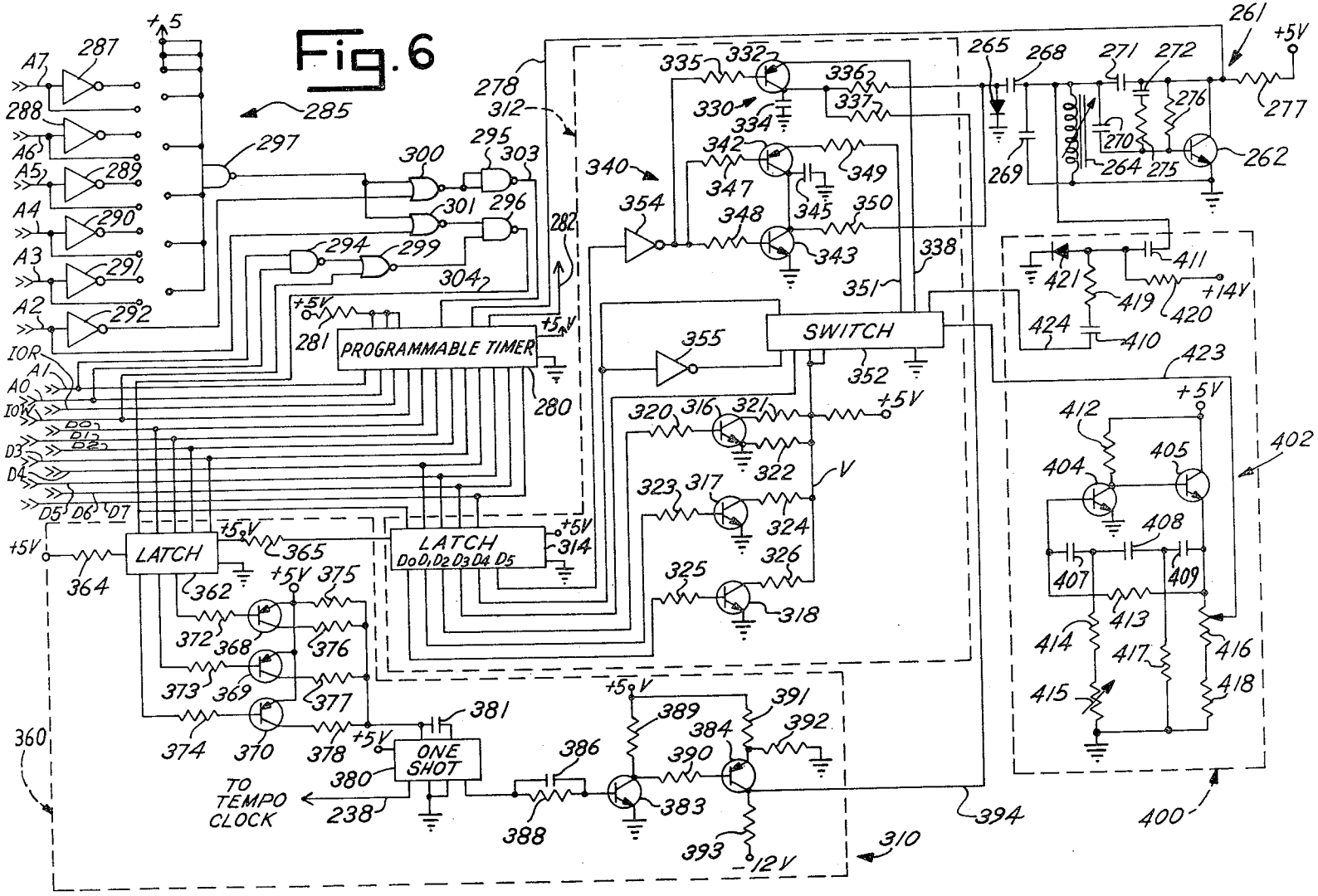
FIG. 6 is an electrical schematic diagram of a preferred form of oscillator used in connection with the present invention.

Referring to FIG. 6, oscillator 260 basically comprises an oscillator circuit 261, a selection circuit 285, a portamento module 310, and a vibrato module 400. Oscillator 261 includes a transistor 262, an inductor 264, a diode 265, capacitors 268–272 and resistors 275–277, connected as shown. The signals generated by the oscillator are transmitted to an input of a programmable timer 280 over a conductor 278. The timer can be implemented by Intel Model No. 8253 which is operated in mode 3, the square wave generator mode, and is described in the Intel data catalogue for 1977 at page 10–159. The timer is biased by a resistor 281 and generates square wave pulses on a conductor 282 at a repetition rate determined by the frequency of the oscillator and the interaction between the oscillator and the other modules shown in FIG. 20.

The operation of oscillator circuit 260 is controlled by the data processor over bus 152 under the supervision of selection circuit 285. Selection circuit 285 includes inverters 287–292, NAND gates 294–297, and NOR gates 299–301. Appropriate inverters are connected to gate 297 depending on the precise addressing code used on conductors A2-A7. By transmitting the proper bit pattern over the address bus, either a pitch select line 303 or a portamento select line 304 is raised to a logical one state. In the event the pitch line is selected, timer 280 is enabled to receive information over data bus D0-D7 which determines the repetition rate of the square wave pulses produced on output conductor 282. In the event the portamento line is selected, the portamento module is enabled to receive information over the data bus which controls the pitch and rate of the portamento feature.

Portamento module 310 includes a portamento pitch control circuit 312 comprising an addressable latch 314 which receives information from the data bus. The latch, in turn, controls transistors 316–318 and associated resistors 320–326 which generate a voltage V that determines the upper and lower portamento pitches.

Module 310 also includes a portamento slide up circuit 330 comprising a transistor 332, a capacitor 334 and resistors 335–337 connected as shown. A portamento slide down circuit 340 is also provided by connecting transistors 342,343, a capacitor 345 and resistors 347–350 as shown. The portamento slide up and slide down circuits are controlled by a quad bilateral switch 352 and by inverters 354,355.

Module 310 also includes a portamento rate control circuit 360 comprising an addressable latch 362, resistors 364–365, switching transistors 368–370, resistors 372–378, a one shot multi-vibrator 380 controlled by a timing capacitor 381, and an amplifier circuit comprising transistors 383,384, a capacitor 386, and resistors 388–393. The output of the amplifier circuit is transmitted over a control line 394 to portamento slide up circuit 330.

Vibrato module 400 includes an oscillator 402 containing transistors 404,405, capacitors 407–411, resistors 412–420 and a diode 421, all connected as shown.

Assuming neither the portamento nor vibrator features are used, oscillator 261 generates a signal which is a multiple of the frequency desired for voice system 251. If a lower frequency is desired, a divisor number equal to the divisor required to achieve that lower frequency is transmitted to timer 280 over the data bus. The timer divides the frequency of the input from oscillator 261 by said divisor number in order to produce pulses on conductor 282 having a repetition rate corresponding to the desired frequency or pitch of the note produced by system 251.

Voice system 251 can be instantaneously quieted of silenced by entering the proper data in timer 280 from data bus 154. The timer then enters a non-counting mode which prevents output pulses on conductor 282. This mode of operation is controlled by a QUIET software routine.

The operation of the voice system 251 during vibrato and portamento modes of operation is described in the above-identified application Ser. no. 3,584.

Figure 7:
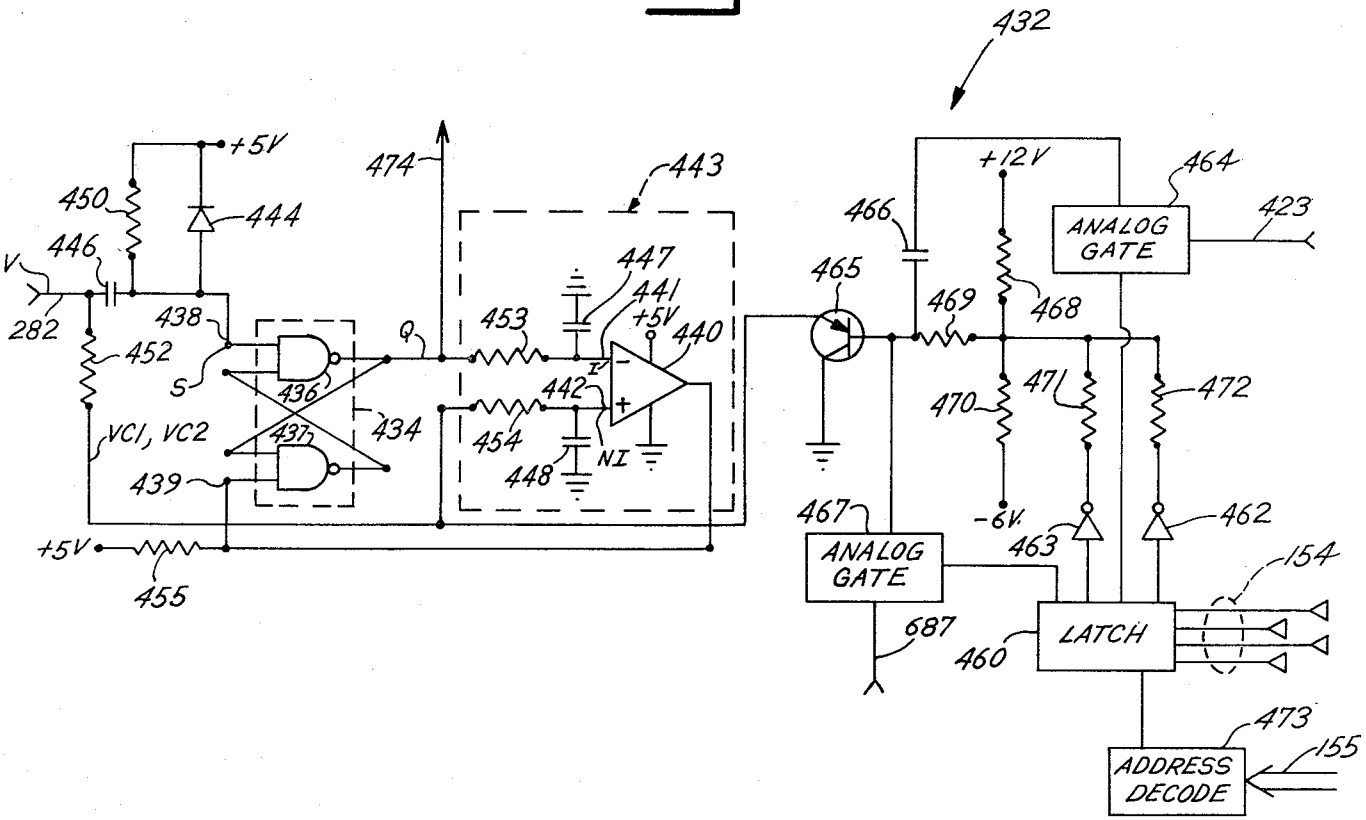
FIG. 7 is an electrical schematic diagram of a preferred form of duty cycle adjustment circuit used in connection with the present invention.

Referring to FIG. 7, harmonic spectrum adjuster 430 comprises a duty cycle adjusting circuit 432 that includes a flipflop 434 consisting of NAND gates 436,437, a set input 438 and a reset input 439. An operational amplifier 440 having an inverting input 441 and a non-inverting input 442 is configured as a balanced comparator 443. The input signal from conductor 282 is differentiated by a capacitor 446 and a resistor 450, and the positive pulse resulting from the differentiation is removed by a diode 444. Additional capacitors 447,448 and resistors 451–455 are connected as shown. Resistors 453,454 have the same value and capacitors 447,448 have the same value in order to provide a balanced comparison by amplifier 440.

The overall operation of the circuit is described in detail in the above-identified application Ser. no. 3,584.

Figure 8:
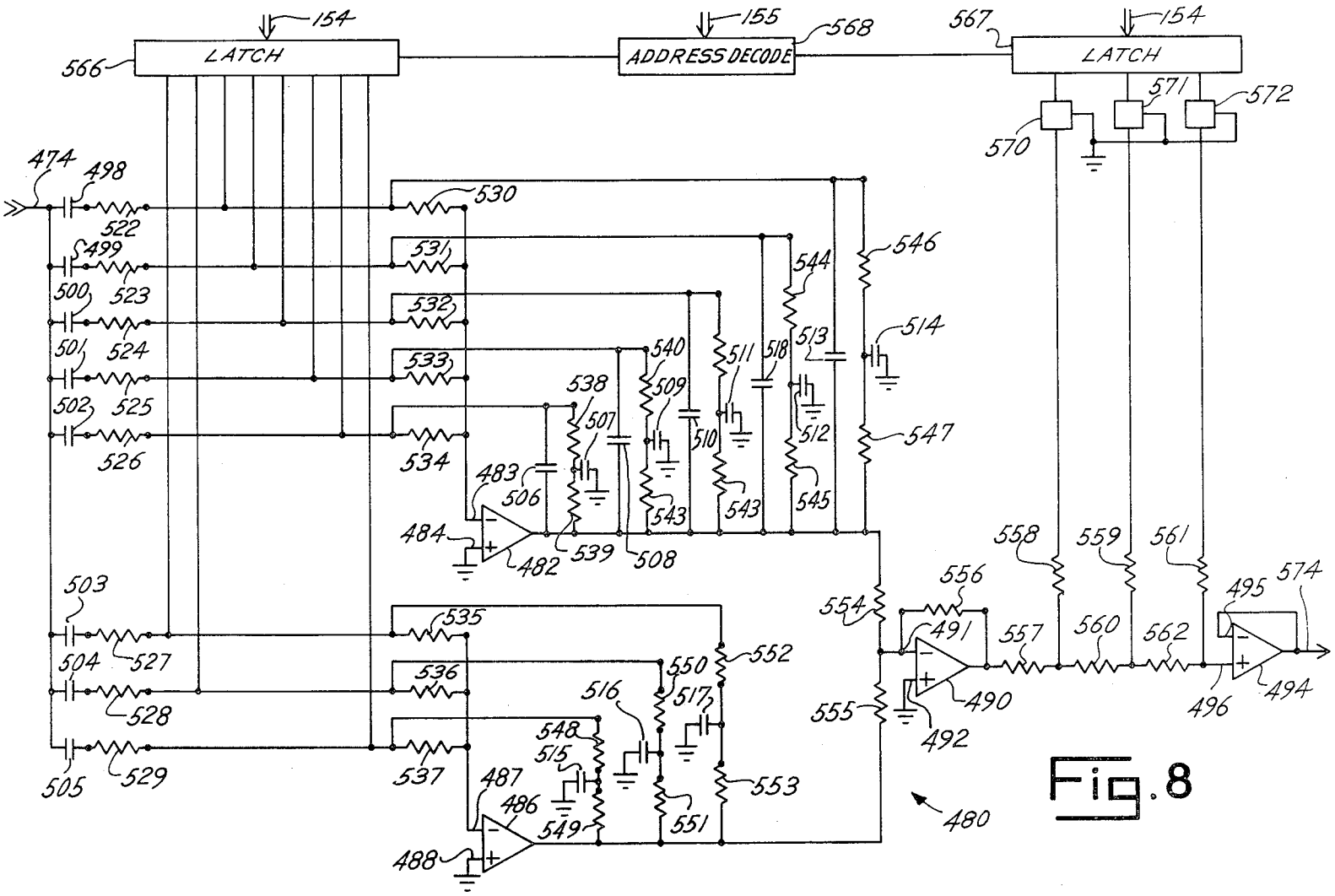
FIG. 8 is an electrical schematic diagram of a preferred form of programmable filter used in connection with the present invention.

Referring to FIG. 8, harmonic spectrum adjuster 430 also comprises a programmable filter 480. The filter includes operational amplifiers 482,486, 490 and 494 having inverting inputs 483, 487, 491 and 495, respectively, and non-inverting inputs 484, 488, 492 and 496, respectively. The filter also includes capacitors 498–518, resistors 522–562, latches 566,567, and address decoder 568, open collector gates 570–572 and an output conductor 574, all connected as shown. When enabled by address decoder 568, latches 566 enables one or more of the resistor-capacitor pairs to be connected into the feedback loops of operational amplifiers 482 or 486 in order to provide adjustable filtering of the pulses received on input conductor 474. When enabled by address decoder 568, latch 567 enables one or more of resistors 558–561 to be connected into the output of operational amplifier 490 through gates 570–572 in order to provide variable attenuation of the filtered signals.

Figure 9:
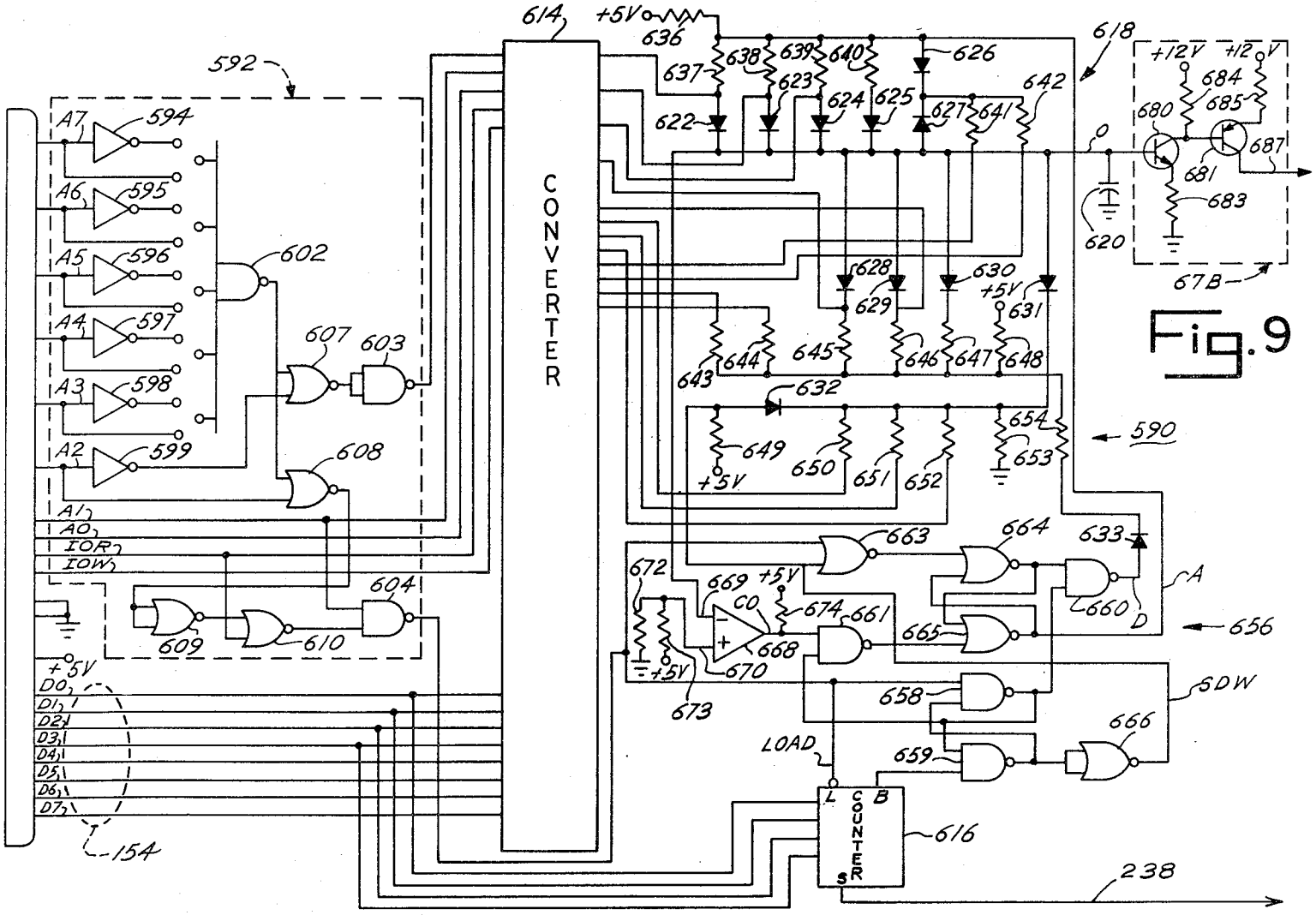
FIG. 9 is an electrical schematic diagram of a preferred form of envelope generator used in connection with the present invention.

Referring to FIG. 9, envelope generator 590 basically comprises an address decoding circuit 592, a parallel-to-parallel converter 614, a counter 616, a time constant circuit 618, a control logic circuit 656 and an output amplifier 678.

The address decoding circuit includes inverters 594–599, NAND gates 602–604 and NOR gates 607–610. The decoding circuit is responsive to signals on the address bus to enable converter 614 or counter 616 to receive information from data bus 154. Converter 614 is a 12-bit wide, open collector latch in which the outputs are grounded or allowed to float under programmed control.

Time constant circuit 618 comprises a timing capacitor 620, diodes 622–633 and resistors 636–654, all connected as shown.

Control logic circuit 656 includes NAND gates 658–661, NOR gates 663–666, an operational amplifier 668 having an inverting input 669 and a non-inverting input 670, and resistors 672–674, all connected as shown.

Output amplifier 678 includes transsistors 680, 681, resistors 683–685 and an output conductor 687.

Envelope generator 590 operates in the manner described in the above-identified application Ser. no. 3,584.

Figure 10:
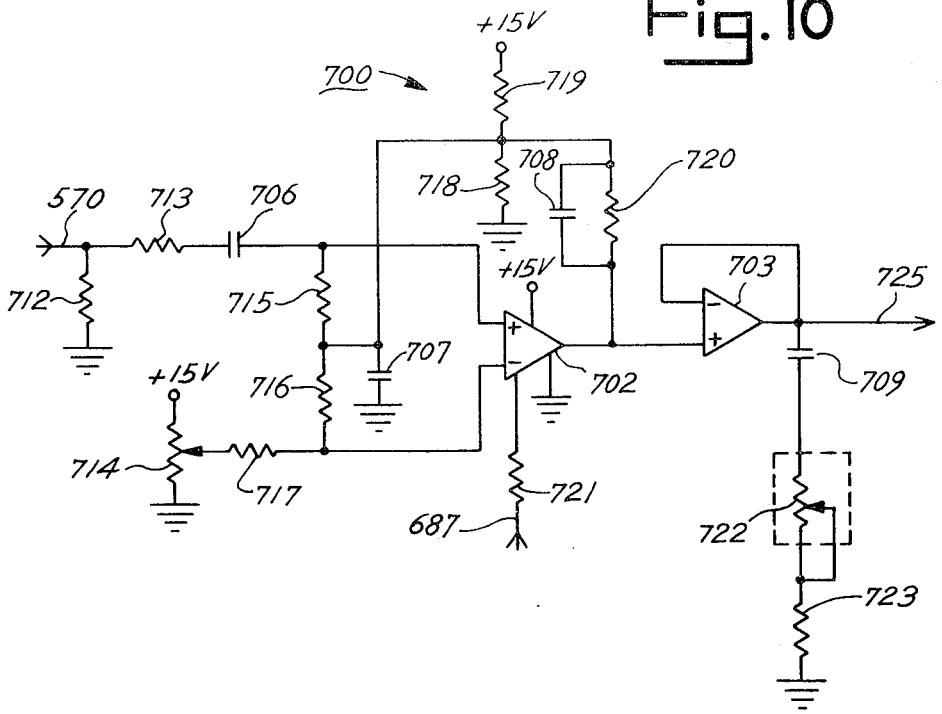
FIG. 10 is an electrical schematic diagram of a preferred form of modulator made in accordance with the present invention.

Referring to FIG. 10, modulator 700 comprises operational amplifiers 702,703, capacitors 706–709 and resistors 712–723, connected as shown. The modulator modulates the filtered audio signals received from harmonic spectrum adjuster 430 in accordance with the envelope signal received from envelope generator 590 in order to produce one note of a musical accompaniment on an output conductor 725. The note represents one pitch of one instrument or voice. Other pitches and instruments can be represented by additional voice system 252–256.

V. Overall Operation

Figure 11:
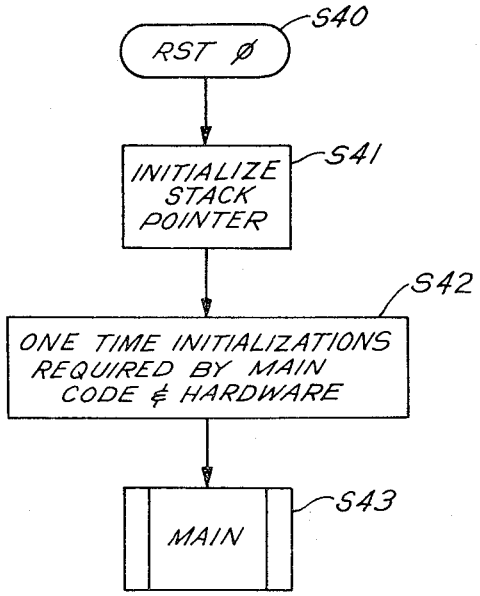

The overall musical instrument is controlled by means of a program stored in ROM 162 which is executed by microprocessor 170. When the instrument is turned on, there are several one-time initialization functions which are performed. Various counters, pointers and variables are initialized by a program called INITLZ. A working area in RAM 166 is set up for stack pointers used by various programs, and a means for swapping these pointers is provided. Each of these initialization procedures is described in steps S40-S43 of the flow chart of FIG. 11.

Figure 12:
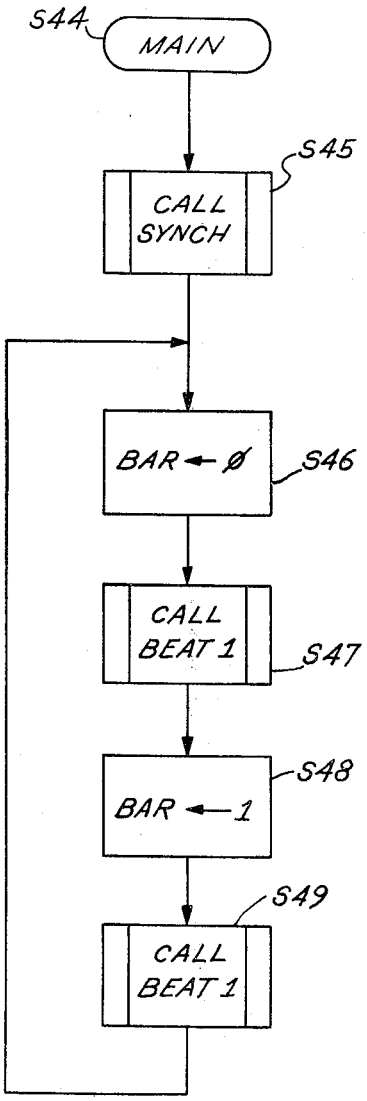

Referring to FIG. 12, the program called Main works on a philosophy of four levels. The outer level responds to the musical style (e.g., bossa nova, big band, etc.) selected by the performer, and arranges the logic for two complete musical bars. The second or bar level arranges for the output of four beats for a normal bar and three beats for a waltz bar. The third or beat level arranges for the output of twelve tempo clock pulses. The fourth or clock pulse level locates the proper orchestration and instrument data stored in ROM 164, creates the requisite parameter signals, and outputs the parameter signals to the voice systems in order to create the accompaniment sound.

As shown in step S45 of FIG. 12, the Main program first performs a synchronizaton function which enables the system and tempo clock 232 to use the same clock pulse as a down beat. Main waits in a loop until it detects a down beat condition and then allows continuation of the program. Main then enters an endless loop which is the outer loop for playing the two-bar pattern. The variable BAR is assigned the value 0 in step S46, and the routine BEAT 1 is called in step S47. BEAT 1 plays one bar (three or four beats) which is identified by the contents of the variable BAR. If BAR is assigned the value 0, the first bar is played; if BAR is assigned the value 1, the second bar is played (See steps S48 and S49). The foregoing loop is performed continuously, alternately playing bar 1 and then playing bar 2.

Figure 13:
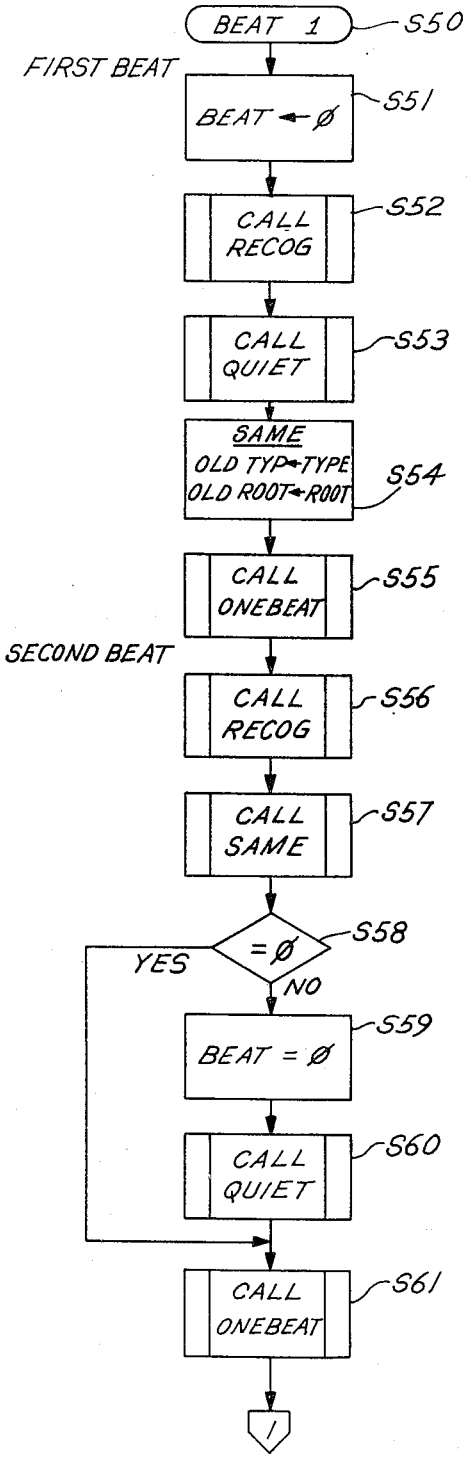

The BEAT 1 routine called by Main is described in the flow charts of FIGS. 13 and 14. Referring to FIG. 13, BEAT 1 determines when chords are recognized (with respect to beats in a bar), determines the response to an invalid chord played by the performer, and determines the response to a change of chords by the player between the two beat phrases. As described earlier, bars are broken into two parts or phrases. The first of the two phrases always includes two beats, that is beat 1 and beat 2. The second phrase always includes beat 3 and will include beat 4 unless a waltz bar is indicated. The musical bars are broken into these multi-beat phrases so that the proper musical phrasing can be incorporated into the musical accompaniment segments. A unique musical accompaniment segment exists for each musical phrase. If the system recognizes a chord type change between an old phrase and a new phrase, a new unique musical accompaniment is played in the new phrase. However, if a chord type is changed between beats within a phrase, a special operation is required to retain the continuity of the musical phrasing. The musical importance of these operation is described in detail in the above-identified application Ser. No. 3,584.

Referring to the flow charts of FIGS. 13 and 14, during the first beat, the variable BEAT is set to 0 (step S51), and the harmony recognition routine (FIG. 5) is called (step S52) in order to determine the chord type and root desired by the performer. In step S53, the QUIET routine is called to prevent any overhang from a previous musical segment. As previously explained, QUIET enters a number in timer 280 through data bus 154 (FIG. 6) which prevents oscillator 260 from emitting pulses. Overhang may result when a note continues between beats 1 and 2 or between beats 3 and 4. For example, many of the musical segments are written so that notes continue uninterrupted between beats 2 and 3 or between beats 4 and 1. Thus, between these beats, the QUIET routine prevents a conflict between the notes of the old beats and the notes of the new beats. In addition, overhang can result due to a long release decay which extends the envelope generated by generator 590 into the next beat.

If the recognition routine discovers a new chord type or new root, the identification of the new chord type or new root is stored in step S54 by a routine called SAME. The routine determines whether the new chord type and root are the same as the old chord type and root.

After any new chord types or roots have been handled in step S54, the ONE BEAT routine is called in step S55. The ONE BEAT routine arranges for the output of one entire beat (12 tempo clock pulses) and then increments the variable BEAT so that the second beat of the current bar is processed.

During the second beat, the recognition routine again is called in step S56, and any new chord type or root is stored by the SAME routine in step S57. If the chord type and root have not changed between the beats 1 and 2 (i.e., if they are the same), step S58 directs the program to call the one beat routine (step S61). If the chord type or root has changed, step S58 compels the BEAT variable to return to a 0 value and calls the QUIET routine in steps S59 and S60, so that the musical accompaniment for the first beat will be produced during beat 2. As previously explained, this procedure is necessary when the chord type or root has changed between the beats of a 2 beat phrase.

Referring to FIG. 14, during the third beat of the bar, the variable BEAT is incremented to the value 2 in step S62. Steps S63–S66 then follow the same procedure followed by steps S52–S55, in connection with the first beat (FIG. 13). At step S67, the input downbeat routine (INDB) is called to determine whether the third beat completes a 3 beat waltz phrase or whether a fourth beat is required. If the accompaniment is being played in waltz time, the musical phrase is completed, and the program is returned through steps S68 and S69.

In the event a fourth beat is required, the recognition routine is called in step S70, and any change in chord type or root is detected in step S71. In the event that neither the chord type nor root was changed, step S72 jumps the program to step S75 which calls the ONE BEAT routine. If a new chord type or root was detected in step S73, and the QUIET routine is called in step S74, so that a musical accompaniment for the first beat will be played in step S75. At the conclusion of the fourth beat, the program is returned through step S76.

The ONE BEAT routine called by the BEAT 1 routine (FIGS. 13 and 14) is shown in the flow chart of FIG. 15. In step S79, a variable CLKCNT is set to 0. CLKCNT counts the number of tempo clock pulses and has a value which can vary from 0 to 11, since there are 12 clock pulses in each beat.

Figure 21:
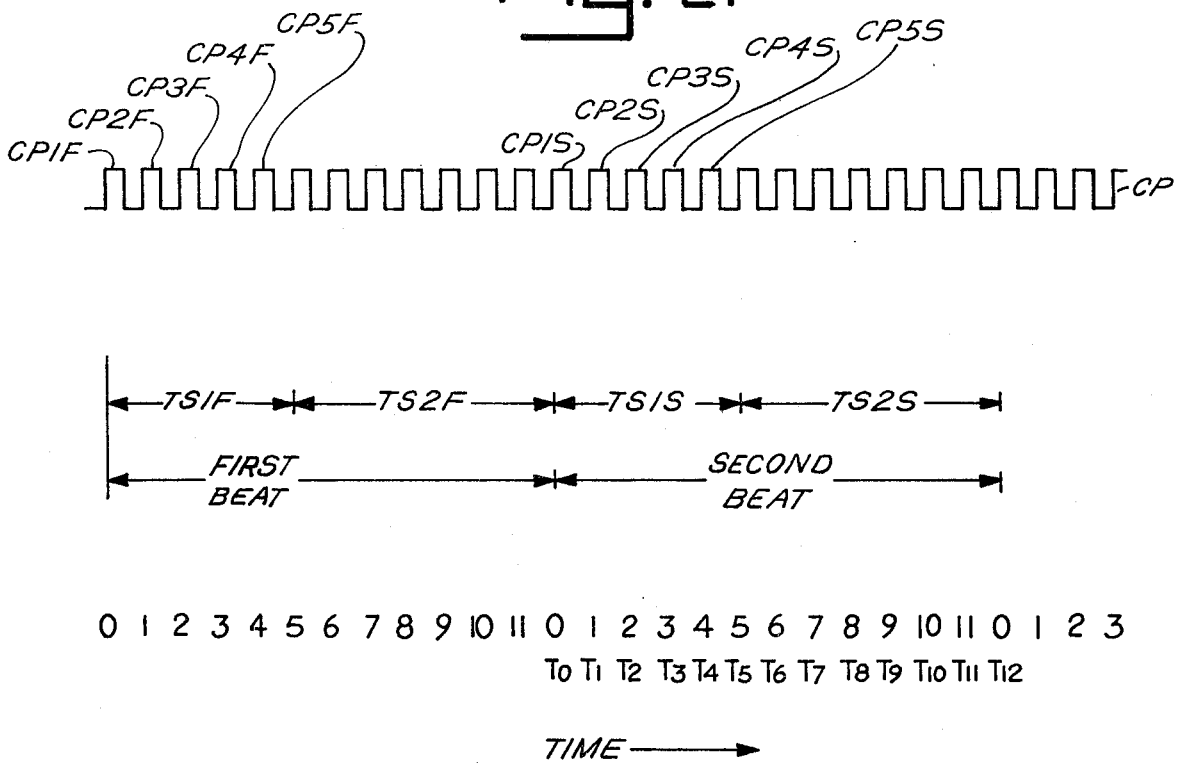
FIG. 21 is a timing diagram illustrating the division of beat into time segments by the tempo clock.

As shown in FIG. 21, the clock pulses CP, divide each beat into two time segments. For example, time segments TSIF and TSIS occur during clocks pulses 1-5 (i.e., CP1F-CP5F and CP1S-CP5S) of the first and second beats, respectively. Likewise, time segments TS2F and TS2S occur during the remaining clock pulses 6-11 of the first and second beats, respectively. Each of the other beats in a musical segment is divided in like manner. Returning to FIG. 15, the OUTPUT routine is called in step S80, and the ONE BEAT routine then waits for a tempo clock transition at step S81. When a clock transition is sensed, the CLKCNT variable is incremented in step S82. In step S82A, the WINDOW routine is called to determine whether any changes in harmony occur during time segment TS1. The OUTPUT routine again is called if the end of the beat has not occurred (i.e., if CLKCNT is less than 11). When CLKCNT reaches 11, step S83 causes the variable BEAT to be incremented in step S84, and causes a return to the BEAT 1 routine (FIGS. 13 and 14) in step S85.

Figure 16:
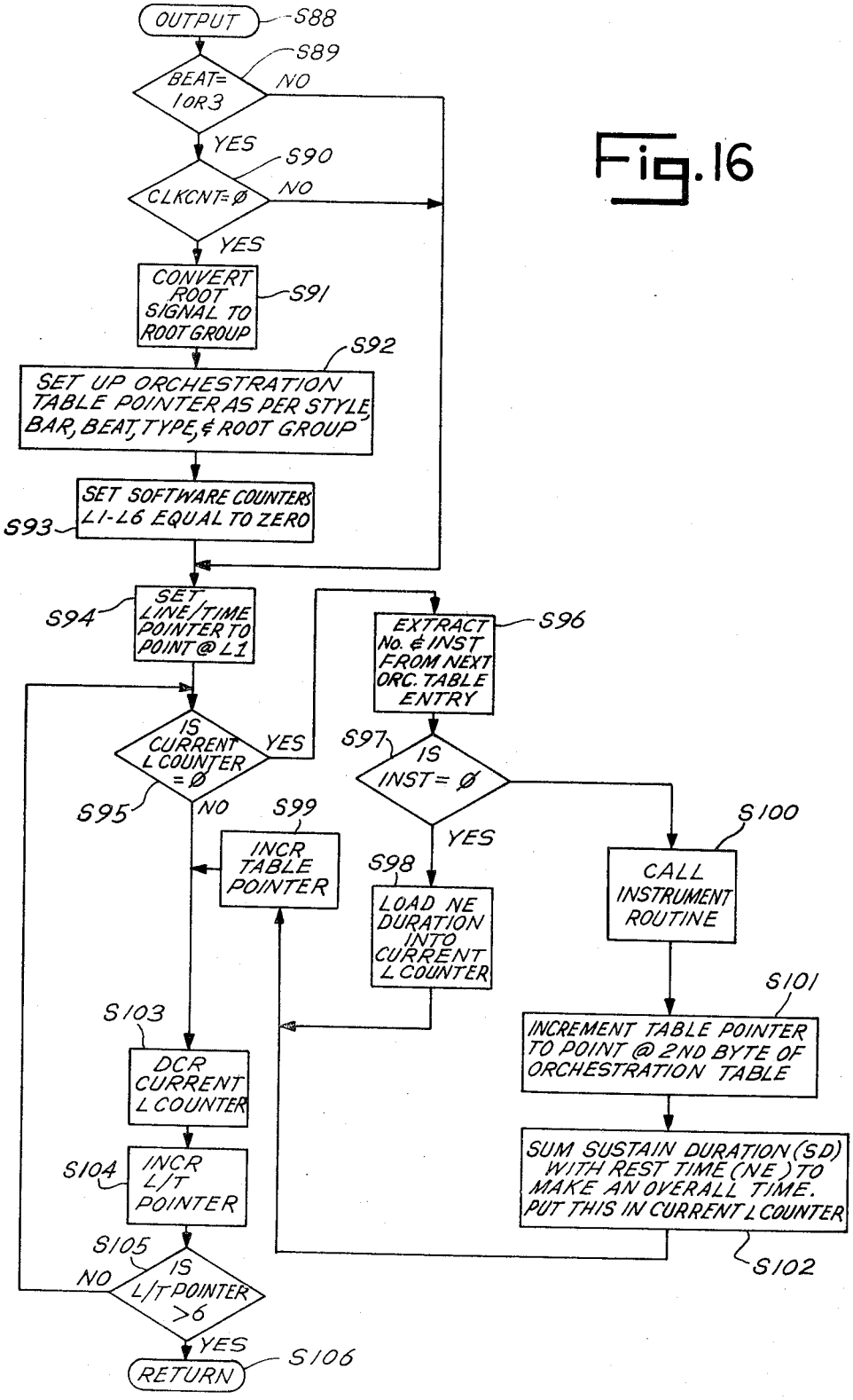

The OUTPUT routine called during the ONE BEAT routine is described in FIG. 16. Assuming the beat is 1 or 3 and the tempo clock count is 0 (Steps S89, S90), the root signal obtained by the harmony recognition routine (FIG. 5) is converted to one of the root groups previously identified in step S91. In step S92, a table pointer to the orchestration table in ROM 164 is set up according to the musical style selected by the performer, the bar, the beat, the chord type and the root group.

Figure 20:
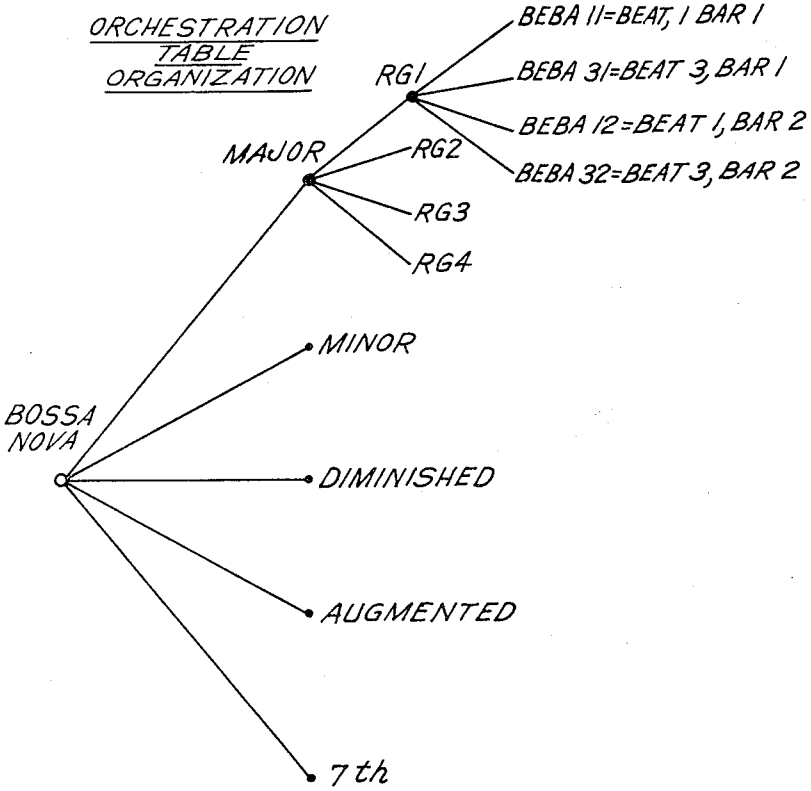
FIG. 20 is a diagram illustrating the organization of the orchestration tables stored in the memory of the preferred embodiment.

The organization of the orchestration table in ROM 164 is illustrated in FIG. 20. As shown in that Figure, each musical style selected by the performer, (such as bossa nova) can point to any one of the five different chord types recognized by the harmony recognition routine (i.e., major, minor, diminished, augmented and seventh). In turn, each chord type can point to any one of the four different root groups, and each of the root groups can point to an address identifying any one of four different combinations of beat and bar (i.e., beat 1, bar 1; beat 3, bar 1; beat 1, bar 2; and beat 3, bar 2).

Referring again to FIG. 16, step S93, after the table pointer is set up to point to the proper address of the orchestration table, six software counters L1-L6 corresponding to the six voice systems 251-256 are set equal to 0. In step S94, a line/time pointer is set to point to counter L1. The software counters L1-L6 determine when a new note needs to be produced by one of voice systems 251-256. If the counter has not been decremented to 0, no new note needs to be produced, and the voice system can be ignored by the microprocessor. However, when one of counters L1-L6 is decremented to 0, orchestration signals must be read from ROM 164 in order to produce the next note. The orchestration signals located in ROM 164 are stored in the form illustrated in the following Table 1, in which an "x" indicates a bit of a word:

TABLE 1

| Orchestration Table Entry | | | |
|---|---|---|---|
| 1st Byte | | 2nd Byte | |
| x x x x x | x x x | x x x x | x x x x |
| NO | INST | S.D. | N.E. |

Each orchestration table entry consists of two bytes. The first byte comprises (a) a five bit word NO which is related to the pitch of the note to be produced, and (b) a three bit word INST which defines the type of instrument or voice which the note is to simulate. The second byte comprises (a) a four bit word S.D. which defines the duration of the sustain time of the envelope generator and (b) another four bit word N.E. which defines the rest time until the next note of the voice is produced. As previously described in connection with FIG. 9, the S.D. word is transmitted to counter 616 in order to generate the proper envelope for the production of the note.

Returning to FIG. 16, if the current L counter is 0, the NO and INST words are read out of the orchestration table in step S96. According to step S97, if the value of the INST word is 0, a musical rest is indicated, and the value N.E. is loaded into the current L counter in step S98. In step S99, the pointer for the L counters is incremented to point to the next counter, and, in step S103, the current L counter is decremented.

Since the OUTPUT routine is executed once during each tempo clock pulse, the L counters are decremented once during each such clock pulse. As a result, the L counters are kept in synchronism with the tempo clock pulses. After all of the L counters have been serviced during a tempo clock pulse, the program returns to the ONE BEAT routine through steps S105 and S106. If all L counters have not been serviced, the routine returns to step S95 and is repeated with respect to the remaining L counters.

Returning to step S97, if the value of the INST word is not equal to 0, a real instrument is indicated, and the instrument routine (INSTRU) is called in step S100. After INSTRU is completed, the orchestration table pointer is moved to the second byte of the orchestration table entry (See Table 1) in step S101. The sum of the sustain duration and rest time (i.e., the sum of words S.D. and N.E.) then is loaded into the current L counter in step S102 in order to define the next time when the voice system corresponding to the current L counter needs service. The table pointers then are incremented in step S99, and the routine follows the previously-described steps S103-S106.

Figure 19:
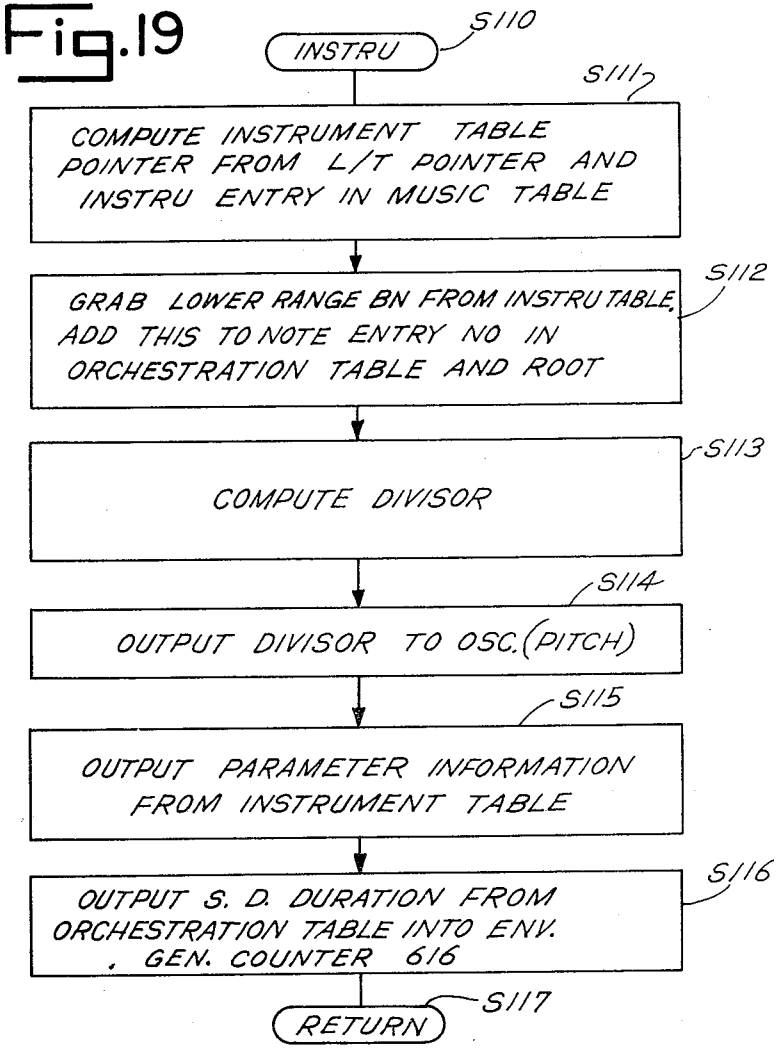

Referring to FIG. 19, when the instrument routine (INSTRU) is called, a pointer to the proper entry in the instrument table stored in ROM 164 is calculated from the current value of the line/time pointer (step S94) and from the INST word stored in the orchestration table (Table 1) (step S111). The instrument signals located in ROM 164 are stored in the form illustrated in the following Table 2:

TABLE 2

| INSTRUMENT TABLE ENTRY | | | | |
|---|---|---|---|---|
| 1. | x x x x x x x x<br>Base Number (BN) (0–95, 8 Octaves) | | | |
| 2. | x x x<br>Attack(A) | x x<br>Percussive Decay(PD) | x x<br>Sustain Level (S) | x<br>— |
| 3. | x x x<br>Release Decay (D) | x x<br>Percussive Release (PR) | x x x<br>— | |
| 4. | x x x<br>Pulse Width (latch 460) | x<br>"WAH" On (And Gate 467) | x<br>Vib. Mod. On (And Gate 464) | x x x<br>— |
| 5. | x x x x x x x x<br>Volume Control (To Filter Latch 567) | | | |
| 6. | x x x x x x x x<br>Portamento and Vibrato Control (To Latch 314) | | | |
| 7. | x x x x x x x x<br>Portamento Rate (To Latch 362) | | | |
| 8. | x x x x x x x x<br>Filter characteristic (To Filter Latch 566) | | | |

Each entry consists of eight words, and each word has 8 bits. Once the proper entry in the instrument table is addressed by the calculated pointer, a base number BN is read out of word 1 of the entry. BN defines the lowest pitch which can be played by an instrument or voice. In step S112, the microprocessor sums BN+NO (from the orchestration table)+the value of the root (from counter 228, FIG. 3) to obtain a value P. In steps S113 and S114, the value P is used to compute the divisor number which is read out to timer 280 in oscillator 260 on data bus 154. As previously described, the divisor number determines the pitch of the note to be produced by one of voice systems 251–256. In step S115, the parameter signals stored as words 2–8 in the instrument table entry are transmitted over bus 154 to the appropriate latches of the proper voice system. A detailed description of words 2–8 is found in the above-identified application Ser. No. 3,584.

Referring again to FIG. 19, in step S116, the value SD is read from the orchestration table into counter 616 of the envelope generator (FIG. 9) in order to determine the sustain time duration of the note. The program then is returned to the output routine through step S117. The parameter signals control the designated voice system so that a tone signal having the proper pitch and harmonic spectrum is generated. The tone signals from each of the voice systems are summed and amplified in amplifier 77 and are converted to sound waves by transducer 79.

Figure 17:
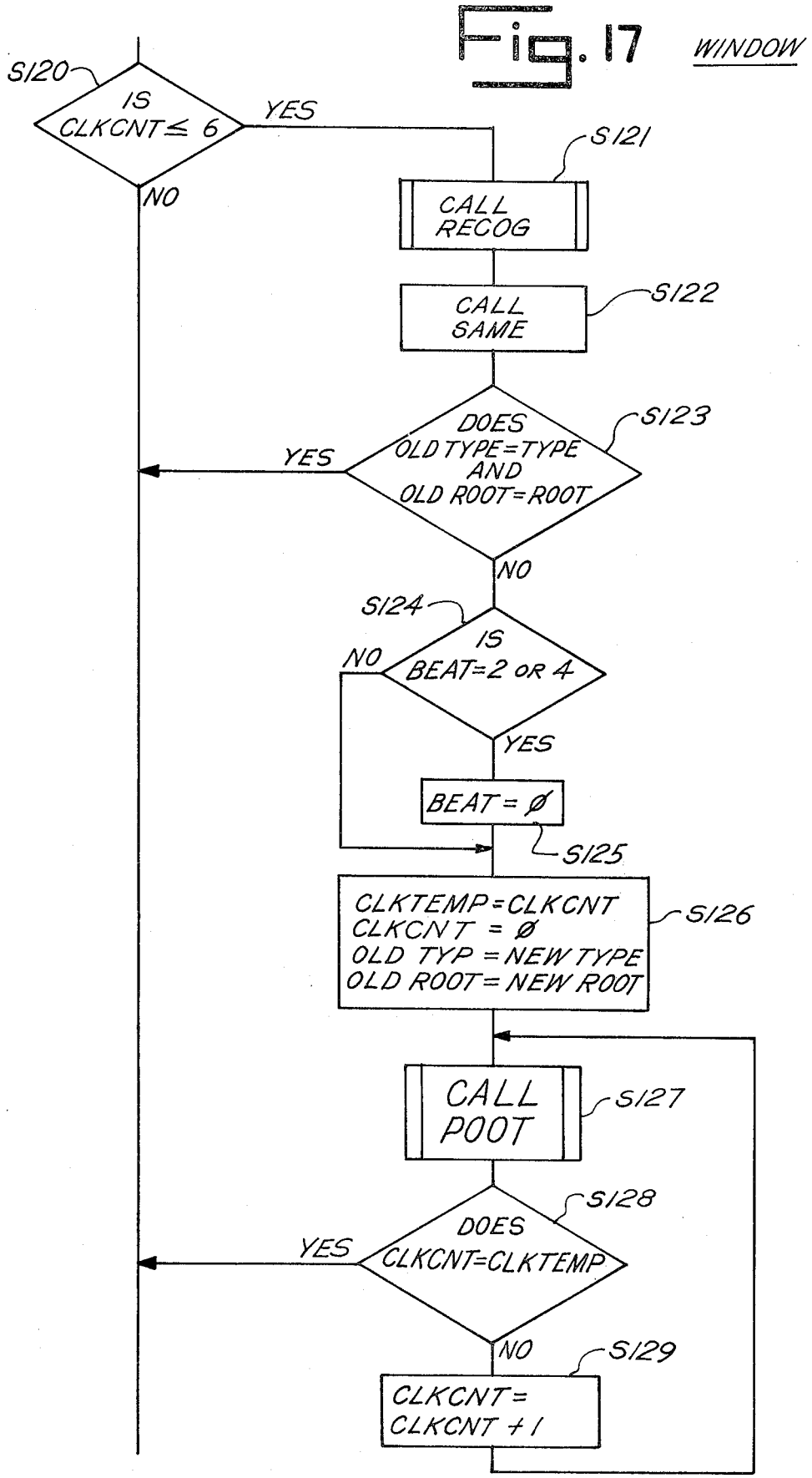

The WINDOW routine referred to in FIG. 15 is described in detail in FIG. 17. In step S120, the routine determines whether the CLKCNT is equal to or less than 6 (i.e., whether the instrument is in time segment TS1 of FIG. 21). If so, the RECOG and SAME routines are called in steps S121 and S122. These routines were earlier described in connection with steps S52 and S54. In step S123, the WINDOW routine determines whether the previously-selected harmony has remained the same. If so, the routine exits to step S83 of the ONE BEAT routine (FIG. 15). If the performer has changed the harmony, steps S124 and S125 change the value of variable BEAT to 0 if the instrument is in the second or fourth beat of the measure. (In the second and fourth beats of the measure, the variable BEAT has the values 1 and 3, respectively). In step S126, the value of variable CLKCNT is stored as value CLKTEMP, CLKCNT is set equal to 0, and the variables OLD TYPE and OLD ROOT are set equal to the new type and root values obtained in step S121.

The routine POOT is called in step S127 in order to interrogate the music signals corresponding to the new type and root. (These signals were described in tables 1 and 2.) POOT locates the new music signals appropriate for use subsequent to the current CLKCNT and synchronizes the new music signals with the tempo clock. Steps S128 and S129 cause POOT to be repeatedly executed until CLKCNT=CLKTEMP. At the time the addressing of the music signals is synchronized with the clock pulses and CLKCNT value, and the addressed music signals can be used by the OUTPUT routine. POOT then exits through the WINDOW routine to step S83 of the ONE BEAT routine (FIG. 15).

Figure 18:
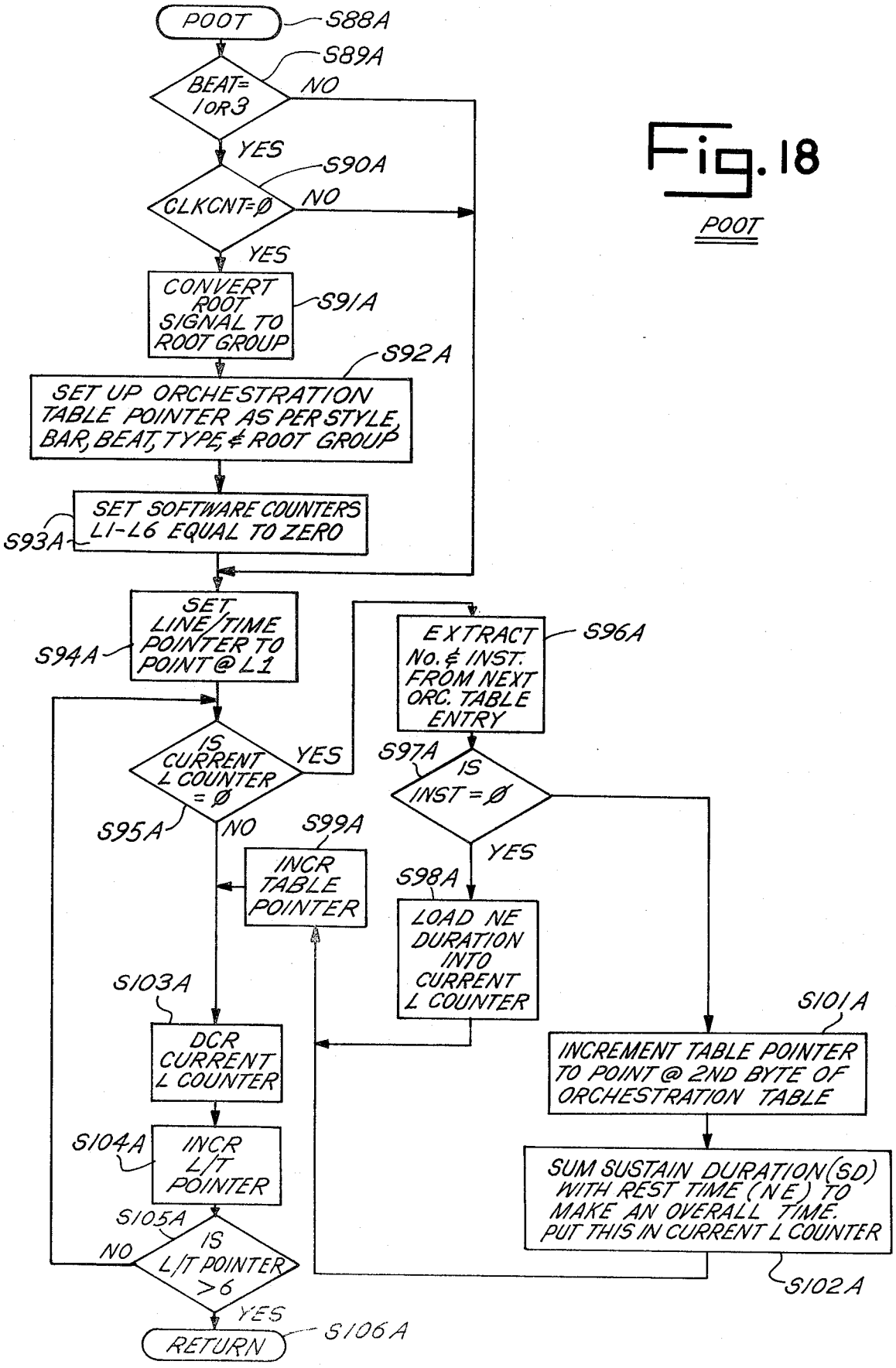

FIG. 18 illustrates the POOT routine. POOT is identical to OUTPUT, except that POOT does not call the INSTRUMENT routine. In FIG. 18, the like steps of POOT and OUTPUT have been given like numbers, except that the POOT steps bear the suffix "A". POOT can be understood with reference to the preceding description of OUTPUT (FIG. 16). As shown in FIG. 18, POOT addresses the music signals stored in ROM like OUTPUT, but POOT operates at a much faster rate than OUTPUT. As previously explained, OUTPUT is executed only once during each clock pulse CP. However, POOT is executed as rapidly as possible within the WINDOW routine until CLKCNT=CLKTEMP. Thus, POOT is typically executed several times within a small fraction of the period of one clock pulse.

The operation of WINDOW and POOT can best be explained by an example. Referring to FIG. 21, assume that the instrument is playing a musical segment based on a C major chord during time segment TS1F (FIG. 21). During time segment TS2F, the preformer lifts his hand from the keyboard and prepares to play in A minor chord. The instrument continues to play a musical segment in C major harmony even though the performer is no longer depressing keys. This is an important feature which facilitates chord changes by unskilled players. As shown in FIG. 17, since CLKCNT is 6 or greater during time segment TS2F, the keyboard is not monitored by RECOG and POOT is not called, so that the harmony remains the same. As shown in FIGS. 15 and 16, OUTPUT addresses the memory once during each CLKCNT increment in order to service the line/time pointers and to keep parameter signals flowing to the output circuits as needed. Thus, OUTPUT addresses the memory and generates the parameter signals in synchronism with the clock pulses at a rate determined by the clock pulses.

Assume the performer intends to strike an A minor chord at time T0 (FIG. 21) at the beginning of the second beat, but is late and does not strike the A minor chord until time T2 (i.e., he plays behind the beat). During time periods T0 to T2, the harmony is undefined by the performer, and the instrument will generate a musical segment based on a harmony assigned by the instrument program instructions. This harmony probably will sound badly with the melody being played by the performer which is intended for A minor harmony.

Within a few microseconds after the A minor chord is struck at time T2, the ONE BEAT routine is executed (FIG. 15) and causes the WINDOW routine (FIG. 17) to replace the C major root and type with the A minor root and type (steps S123 and S126). POOT is called in step S127 and is used for interrogating the stored set of musical signals corresponding with A minor harmony and for locating within that set the signals appropriate for outputting subsequent to time T2 in the second beat (FIG. 21). The locating is done by rapidly addressing the memory and servicing the line/time pointers under the control of POOT at a rate much more rapid than the same addressing and servicing is performed by OUTPUT. Within a few microseconds, POOT will bring the line/time pointers, table pointers and counters into synchronism with the current CLKCNT so that the musical segment can thereafter continue under the control of OUTPUT in the changed A minor harmony. The instrument then continues to produce a musical segment in A minor harmony for the remainder of the second beat. The rapid updating of output information by POOT during time segment TS1 is an important feature which enables an unskilled performer to hear a substantial portion of a beat in the intended harmony, even though the performer did not play that harmony at the beginning of the beat.

Those skilled in the art will recognize that each of the foregoing chord correction features can be implemented by choosing the proper values for the orchestration and instrument table entries and by placing the entries in an appropriate time sequential order in the memory so that they are available for access when the desired musical notes need to be generated.

A detailed program listing, as well as exemplary entries for the orchestration and instrument tables, was supplied with application Ser. No. 3,584. Those skilled in the art can easily adapt that program listing to implement the flows charts described above.

Those skilled in the art will recognize that the preferred embodiment may be altered and modified without departing from the true spirit and scope of the invention as defined in the appended claims.

What is claimed is:

1. In an electronic musical instrument for enabling a performer to control the production of a musical accompaniment defined in part by rhythmic beats having a period, said instrument including harmony selection means for enabling the performer to select a plurality of different harmonies, apparatus for improving the quality of the accompaniment produced in response to unskilled manipulation of the instrument by the performer comprising in combination:

means for dividing the period of at least some of the beats into at least a first time segment and a second time segment occurring later in the beat than the first time segment;

means responsive to the selection of said different harmonies for generating a segment of music, said responsive means being operative during the first time segment for modifying the segment of music in response to a change in the selected harmony and operative during the second time segment for inhibiting modification of the segment of music in response to a change in the selected harmony, whereby the performer can change to a different harmony at the end of a beat without interrupting the continuity of the musical segment and can hear at least a portion of the subsequent beat in the changed harmony even if the change is not completed until a portion of the subsequent beat has elapsed.

2. Apparatus, as claimed in claim 1, wherein the means responsive to the selection comprises:

output means responsive to parameter signals for creating the segment of music; and processing means for generating the parameter signals, said processing means being operative during the first time segment for modifying the parameter signals in response to a change in the selected harmony so that the segment of music is modified and being operative during the second time segment for inhibiting the output means from modifying the segment of music in response to a change in the selected harmony.

3. Apparatus, as claimed in claim 2, wherein the processing means comprises means operative during the second time segment for inhibiting modification of the parameter signals in response to a change in the selected harmony.

4. Apparatus, as claimed in claim 3, wherein the means for enabling the performer to select a plurality of different harmonies comprises a keyboard and wherein the processing means comprises means for periodically monitoring the performer's manipulation of the keyboard during the first time segment to the exclusion of the second time segment.

5. Apparatus, as claimed in claims 1, 2, 3 or 4, wherein the first time segment commences substantially at the beginning of a beat and wherein the second time segment terminates substantially at the end of said beat.

6. Apparatus, as claimed in claim 2, wherein the means for dividing comprises adjustable tempo means for generating clock pulses defining a time duration of a musical bar in which the accompaniment occurs, said clock pulses dividing the bar into a predetermined number of musical beats and segments of beats.

7. Apparatus, as claimed in claim 6, wherein the tempo means generates first segment tempo clock pulses during the first time segment of the beat and second segment tempo clock pulses during the second time segment of the beat, and wherein the processing means includes means for dividing the parameter signals into a first group corresponding to a first selected harmony and a second group corresponding to a second selected harmony, for generating the second group in place of the first group in the event the second selected harmony replaces the first selected harmony during the first time segment and for continuing to generate the first group in the event the second selected harmony replaces the first selected harmony during the second time segment.

8. Apparatus, as claimed in claim 6 wherein the processing means comprises:

memory means for storing in sequence at least some separate sets of music signals for said different harmonies, each set of music signals defining a unique segment of music; and central processor means operative in a first mode for addressing the memory means in response to the selected harmony at a first rate synchronized with the clock pulses, for reading the addressed music signals from the memory means, for deriving the parameter signals from the music signals, and for transmitting the parameter signals to the output means, and operative in a second mode following a change in selected harmony during the first time segment for addressing the memory means at a second rate greater than the first rate until synchronism between the stored music signals and clock pulses is established.

9. Apparatus, as claimed in claim 1, wherein the harmony selection means comprises a keyboard.

10. A method of improving the quality of a musical accompaniment defined in part by rhythmic beats having a period and produced by an electronic musical instrument capable of defining a plurality of different harmonies by manual manipulation by a performer, said method comprising the steps of:

dividing the period of at least some of the beats into at least a first time segment and a second time segment occurring later in the beat than the first time segment;

storing a separate set of music signals corresponding to at least some of the different harmonies, each set of music signals being stored in order to enable the production of segments of music;

beginning the generation of a first segment of music derived from a first one of the sets of music signals corresponding to a first one of the harmonies selected at the beginning of the first time segment;

terminating the generation of the first segment of music in response to the selection of a second one of the different harmonies at a first point in time during the first time segment;

interrogating a second one of the sets of music signals corresponding to the second harmony and locating within the second set a suitable set of music signals appropriate for use subsequent to the first point in time;

generating a second segment of music derived from the suitable set of music signals during the first time segment;

beginning the generation of a third segment of music derived from the set of music signals corresponding to the harmony selected at the beginning of the second time segment; and continuing the generation of the third segment of music irrespective of changes in the selected harmony during the second time segment, whereby the performer can change to a different harmony at the end of a beat without interrupting the continuity of the musical segment and can hear at least a portion of the subsequent beat in the changed harmony even if the change is not completed until a portion of the subsequent beat has elapsed.

11. A method, as claimed in claim 10, wherein the step of dividing comprises the steps of:

generating clock pulses which divide each beat into a plurality of time segments; and adjusting the rate of the clock pulses to correspond to a desired rhythm.

12. A method, as claimed in claim 11, wherein the step of storing comprises the steps of:

storing a first music signal corresponding to the duration of a note within the musical segment; and storing a second music signal corresponding to a musical parameter of the note other than duration.

13. A method, as claimed in claim 11, wherein the step of beginning the generation comprises the step of addressing the first set of music signals at a first rate synchronized with the clock pulses and wherein the step of interrogating comprises the step of addressing the second set of music signals at a second rate faster than the first rate.

14. A method, as claimed in claim 10, wherein the musical instrument comprises a keyboard capable of defining a plurality of different harmonies by manual manipulation.

* * * * *